US005335731A

United States Patent [19]

Ringgenberg et al.

[11] Patent Number: 5,335,731

[45] Date of Patent: Aug. 9, 1994

[54] FORMATION TESTING APPARATUS AND METHOD

[76] Inventors: Paul D. Ringgenberg, 2101 Brentwood La., Carrollton, Tex. 75006; Harold K. Beck, 655 Estates Dr., Copper Canyon, Tex. 75067

[21] Appl. No.: 965,100

[22] Filed: Oct. 22, 1992

[51] Int. Cl.[5] ..... E21B 43/01; E21B 49/08

[52] U.S. Cl. ..... 166/336; 166/264; 166/386

[58] Field of Search ..... 166/264, 336, 337, 374, 166/381, 386, 250

[56] References Cited

U.S. PATENT DOCUMENTS

| | | | |
|---|---|---|---|
| 3,850,250 | 11/1974 | Holden et al. | 166/315 |
| 3,930,540 | 1/1976 | Holden et al. | 166/315 |
| 3,970,147 | 7/1976 | Jessup et al. | 166/250 |
| 4,044,829 | 8/1977 | Jessup et al. | 166/264 |
| 4,058,165 | 11/1977 | Holden et al. | 166/314 |
| 4,319,634 | 3/1982 | McMahan et al. | 166/250 |
| 4,422,506 | 12/1983 | Beck | 166/324 |
| 4,429,748 | 2/1984 | Beck | 166/324 |
| 4,444,268 | 4/1984 | Barrington | 166/373 |
| 4,448,254 | 5/1984 | Barrington | 166/373 |
| 4,522,266 | 6/1985 | Barrington | 166/330 |
| 4,633,952 | 1/1987 | Ringgenberg | 166/336 |
| 4,646,838 | 3/1987 | Manke | 166/321 |
| 4,650,001 | 3/1987 | Ringgenberg | 166/373 |
| 4,655,288 | 4/1987 | Burris, II et al. | 166/319 |
| 4,657,082 | 4/1987 | Ringgenberg | 166/336 |
| 4,667,743 | 5/1987 | Ringgenberg et al. | 166/321 |
| 4,691,779 | 9/1987 | McMahan et al. | 166/321 |
| 4,711,305 | 12/1987 | Ringgenberg | 166/336 |
| 4,736,798 | 4/1988 | Zunkel | 166/321 |
| 4,848,463 | 7/1989 | Ringgenberg et al. | 166/250 |
| 5,193,621 | 3/1993 | Manke et al. | 166/386 |

OTHER PUBLICATIONS

*Sales & Service Catalog–Halliburton Services*, published by Halliburton Services, Inc., 1985, pp. 2530–2550.

*Primary Examiner*—Terry Lee Melius

[57] ABSTRACT

The present invention provides an apparatus and method for testing a subterranean formation. The inventive apparatus comprises an internal-external differential pressure operated circulation tool, an external pressure operated drill stem testing tool, and an external pressure operated formation testing tool. The drill stem testing tool is positioned in the inventive apparatus beneath the circulation tool and the formation testing tool is positioned in the apparatus beneath the drill stem testing tool. In the method of the present invention, a testing string comprising the inventive apparatus is run into a well bore.

26 Claims, 15 Drawing Sheets

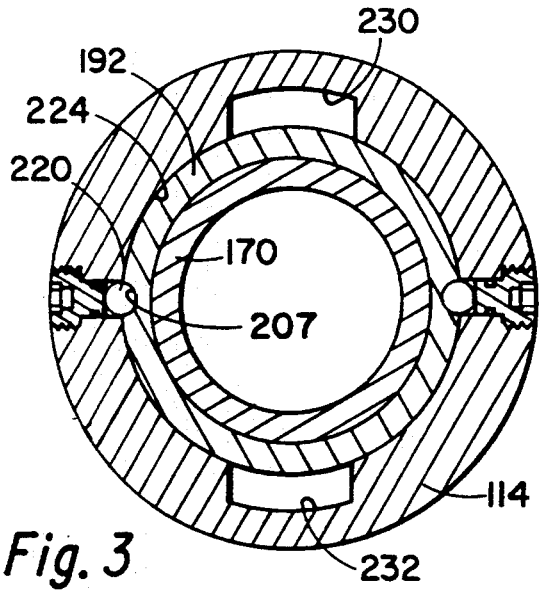
Fig. 3
Fig. 4
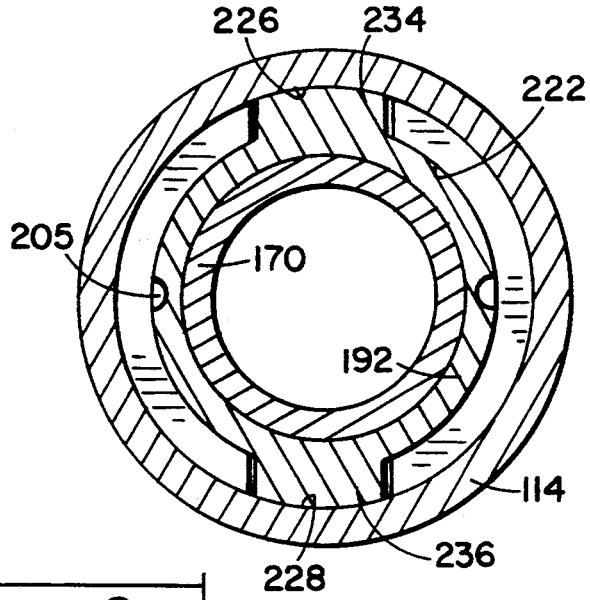
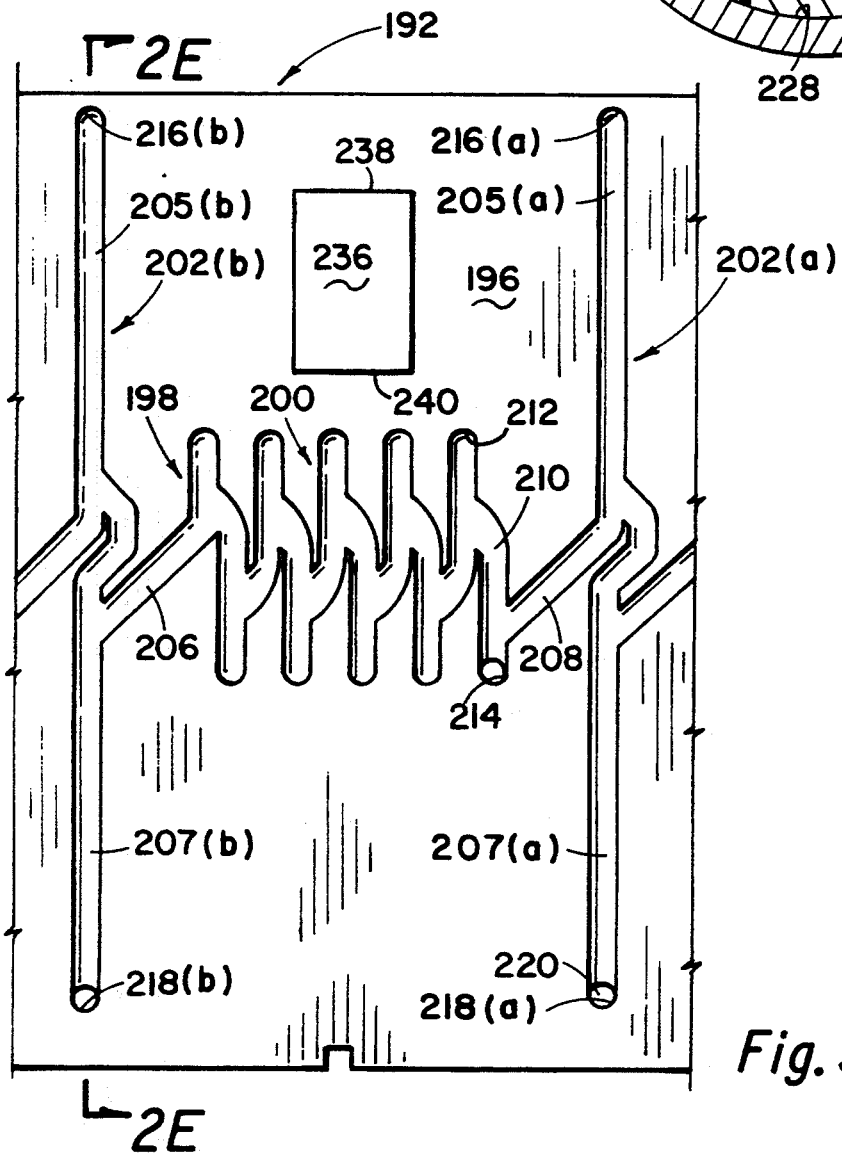
Fig. 5

FORMATION TESTING APPARATUS AND METHOD

BACKGROUND OF THE INVENTION

The present invention relates to methods and apparatus for testing a subterranean formation.

Formation testing operations are commonly conducted to determine the production potential of oil and gas wells. As is well known in the art, these tests are conducted using formation testing strings. A typical formation testing string will include a tester valve and a packer. The tester valve is positioned in the testing string above the packer and, typically, both the tester valve and the packer are positioned near the end of the testing string. When closed, the tester valve operates to block fluid flow through the interior of the testing string.

In conducting a formation test, the testing string is lowered in the well bore until the end of the string reaches the depth of the formation to be tested. The packer is then set in the well bore at a point above the formation. Once the packer is set and the testing string is in place, the formation and the interior of the testing string can be isolated from the well bore annulus. As used herein, the term well bore annulus refers to that portion of the well bore located above the packer and outside of the testing string.

With the formation isolated in the manner just described, formation parameters such as formation flow, pressure, and rapidity of pressure recovery can be determined by alternately opening the tester valve to allow formation flow and closing the tester valve to block formation flow. Pressure readings are taken throughout this procedure in order to determine the production capability of the formation. If desired, a fluid sample can be taken from the formation by including a sampling tool in the testing string.

The testing string also typically includes a circulation valve positioned above the tester valve. At the end of the formation testing program, the circulation valve is opened and formation fluid is circulated out of the testing string. The packer is then released and the testing string is withdrawn from the well bore.

As the testing string is being lowered to its final position in the well bore, drill stem pressure tests are commonly conducted in order to determine if the string contains any leaks. In conducting a drill stem pressure test, an upper interior portion of the testing string is taken out of fluid communication with the well bore. The pressure inside the upper portion of the string is then increased (e.g., by pumping into the testing string) and maintained in order to determine if any fluid escapes therefrom. If a leak is discovered, the portion of the testing string containing the leak must be withdrawn from the well bore so that the leak can be repaired. As is well known in the art, the cumulative length of testing string which must be withdrawn, for leak repair purposes, from the well bore and reinserted during the course of the string lowering process can be minimized by conducting frequent pressure tests as the string is lowered into the well bore.

Various types of tester valves and other downhole tools are known in the art. These include valves and tools which are operated by string rotation, string reciprocation, tubing pressure changes, or differential pressure changes. Annulus pressure operated tools are particularly well suited for offshore applications. Through the use of annulus pressure operated tools, testing string rotation and/or reciprocation is minimized so that the well's blowout preventers can be kept closed during most of the testing operation. By minimizing the amount of time which the blowout preventers must be kept open, annulus pressure operated tools operate to minimize safety and environmental hazards.

U.S. Pat. No. 4,633,952 discloses an annulus operated, multi-mode testing tool. The tool includes a drill pipe tester valve, a circulation valve, a nitrogen displacement valve, and/or a formation tester valve. U.S. Pat. No. 4,633,952 indicates than an independently actuated formation tester valve can be positioned in the testing string below the multi-mode testing tool.

U.S. Pat. No. 4,657,082 discloses a circulation valve which is actuated by changes in the pressure differential existing between the interior of the testing string and the exterior of the testing string. U.S. Pat. No. 4,657,082 indicates that the internal-external differential pressure operated circulation valve disclosed therein can be used in conjunction with a conventional rotation and/or reciprocation actuated circulating valve and an annulus pressure operated tester valve.

U.S. Pat. No. 4,655,288 discloses a tester valve which utilizes a lost-motion valve actuator. The tester valve of U.S. Pat. No. 4,655,288 is annulus pressure actuated. U.S. Pat. No. 4,655,288 also indicates that the tester valve disclosed therein can be used in conjunction with an annulus pressure operated circulation valve.

SUMMARY OF THE INVENTION

The present invention provides an apparatus and method for testing a subterranean formation. The inventive apparatus comprises an internal-external differential pressure operated circulation tool, an external pressure operated drill stem testing tool, and an external pressure operated formation testing tool. The drill stem testing tool is positioned in the inventive apparatus beneath the circulation tool and the formation testing tool is positioned in the apparatus beneath the drill stem testing tool. The circulation tool comprises an elongate tubular housing, having a passageway extending longitudinally therethrough, and a reverse circulation valve means for allowing fluid flow from the exterior of the circulation tool to the circulation tool passageway. The drill stem testing tool comprises an elongate tubular housing, having a passageway extending longitudinally therethrough, and a passageway closure valve means for selectively blocking the drill stem testing tool passageway. The formation testing tool comprises an elongate tubular housing, having a passageway extending longitudinally therethrough, and a passageway closure valve means for selectively blocking the formation testing tool passageway. In the method of the present invention, a testing string comprising the inventive apparatus is run into a well bore.

As discussed more fully hereinbelow, the present invention provides numerous advantages over the prior art. For example, the present invention simplifies the drill stem testing process and thereby facilitates the performance of more frequent drill stem pressure tests. The present invention also allows the performance of relatively high pressure formation tests. Additionally, the present invention allows the testing string to fill with fluid as it is run into the well bore so that the internal hydrostatic pressure of the testing string is equalized with the hydrostatic pressure outside the testing string during the entire lowering process. This hydrostatic pressure equalization greatly reduces the risk that a blowout will occur in the event that a downhole valve fails. The fact that the testing string fills with fluid automatically as it is lowered into the well also eliminates the need to pump large quantities of fluid down the testing string in order to conduct drill stem pressure tests.

Other and further objects, features, and advantages of the present invention will be readily apparent to those skilled in the art upon reference to the attached drawings and upon reading the following Description of the Preferred Embodiments.

DESCRIPTION OF THE DRAWINGS

FIG. 3 provides a cross-sectional view taken along lines 3—3 in FIG. 2E.

FIG. 4 provides a cross-sectional view taken along lines 4—4 in FIG. 2E.

FIG. 5 provides a laid-out view of a portion of a cylindrical indexing sleeve used in the circulation tool of FIGS. 2A–2F. FIG. 5 shows the portion of the cyclindrical indexing sleeve as if said portion had been rolled out flat into a rectangular shape.

DESCRIPTION OF THE PREFERRED EMBODIMENTS

The Inventive Apparatus

Figure 1:
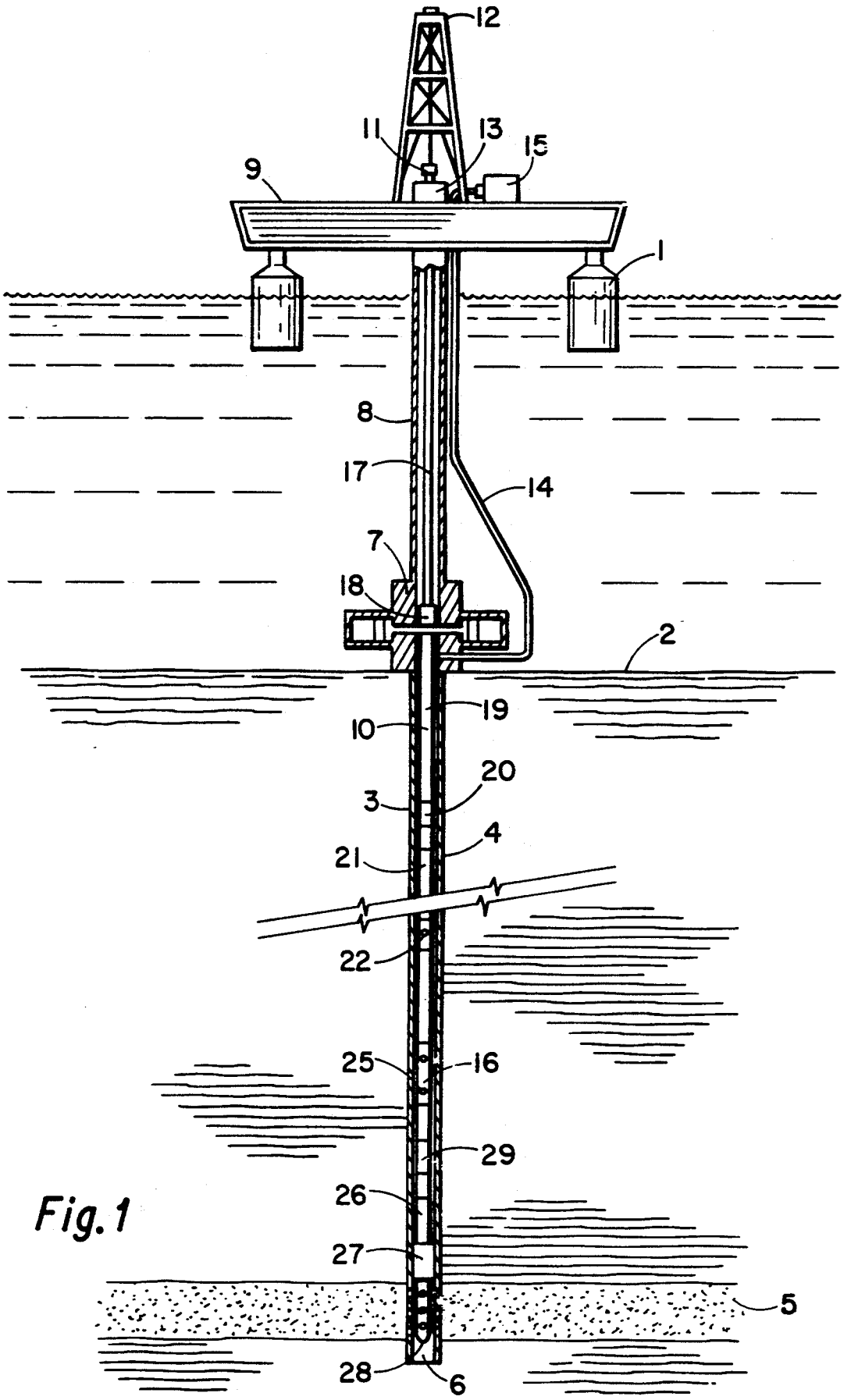
FIG. 1 provides a schematic elevational view of a formation testing arrangement which incorporates the apparatus of the present invention.

As indicated above, the inventive well testing apparatus of the present invention generally comprises a testing string which includes an internal-external differential pressure operated circulation tool, an annulus pressure operated drill stem tester tool, and an annulus pressure operated formation tester tool. As shown in FIG. 1, the annulus pressure operated drill stem tester tool 25 is positioned in the testing string below the internal-external differential pressure operated circulation tool 22 and the annulus pressure operated formation tester tool 29 is positioned in the testing string below drill stem tester tool 25.

FIG. 1 illustrates a general formation testing arrangement which incorporates the apparatus of the present invention. The arrangement of FIG. 1 includes a floating work station 1 stationed over a submerged work site 2. FIG. 1 depicts a well comprising a well bore 3 lined with a casing string 4. Well bore 3 and casing string 4 extend from the work site 2 to a submerged formation 5. The casing string 4 includes a plurality of perforations at its lower end which provide fluid communication between the formation 5 and the interior 6 of well bore 3.

At the submerged well site is located a well head installation 7 which includes blowout preventer mechanisms. A marine conductor 8 extends from well head installation 7 to floating work station 1. The floating work station includes a work deck 9 which supports a derrick 12. The derrick 12 supports a hoisting means 11 which is used to raise and lower formation testing string 10. A well head closure 13 is provided at the upper end of marine conductor 8.

A supply conduit 14 extends from a hydraulic pump 15 on the deck 9 of the floating station 1 to well head installation 7. Supply conduit 14 is connected to well head installation 7 at a point below the blowout preventers whereby pump 15 can be used to pressurize the well bore annulus 16 surrounding testing string 10.

The testing string includes an upper conduit string portion 17 extending from work site 1 to well head installation 7. A hydraulically operated conduit string test tree 18 is located at the lower end of upper conduit string 17 and is landed in well head installation 7 in order to support the lower portion of the formation testing string. The lower portion of the formation testing string extends from the test tree 18 to the formation 5. A packer mechanism 27 isolates the formation 5 from well annulus 16. A perforated tail piece 28 is provided at the lower end of testing string 10 to allow fluid communication between formation 5 and the interior of testing string 10.

The lower portion of testing string 10 further includes intermediate conduit portion 19 and a torque transmitting, pressure and volume balanced slip joint means 20. An intermediate conduit portion 21 is provided for imparting setting weight to packer mechanism 27.

In accordance with the present invention, an internal-external differential pressure operated circulation tool 22, an external pressure operated drill stem tester tool 25, and an external pressure operated formation tester tool 29 are positioned in testing string 10 near the lower end thereof. As shown in FIG. 1, drill stem tester tool 25 is positioned in the testing string below circulation tool 22. As further shown in FIG. 1, formation tester tool 29 is positioned in the testing string below drill stem tester tool 25.

A pressure recording device 26 is located below external pressure operated formation tester valve 29. The pressure recording device 26 is preferably one which provides a fully open passageway through the center thereof so that a full opening passageway is provided through the entire length of the formation testing string.

It may be desirable to include additional formation testing equipment in testing string 10. For instance, where it is feared that the testing string 10 may become stuck in well bore 3, a jar mechanism can be included in the testing string between pressure recorder 26 and packer assembly 27. Should the testing string become stuck in the well bore, the jar mechanism can be used to impart blows to the testing string and thereby free the testing string. It may also be desirable to include a safety joint in the testing string between the jar and packer mechanism 27. The incorporation of a safety joint would allow testing string 10 to be disconnected from packer assembly 27 in the event that the jarring mechanism is unable to free the formation testing string.

The location of pressure recording device 26 may be varied as desired. For instance, the pressure recorder can be located below perforated tail piece 28 in an anchor shoe running case. If desired, pressure recorders may be included in testing string 10 at positions both above and below formation tester tool 29.

The Internal-External Differential Pressure Operated Circulation Tool

The internal-external differential pressure operated circulation tool 22 used in the instant invention preferably comprises a cylindrical housing having an open fluid flow passageway extending longitudinally therethrough and a circulation port disposed through the wall thereof. A valve mandrel is slideably received in the housing and is moveable between a first position closing the circulation port and a second position wherein fluid may be circulated through the circulation port from the well bore annulus 16 to the fluid flow passageway extending longitudinally through the interior of tool 22. A piston means, slideably received in the housing, is operatively connected to the valve mandrel. The piston-means includes a first portion subject to the pressure in well bore annulus 16 and a second portion subject to the pressure inside the testing string. The piston means is operable for moving the valve mandrel toward one of the above-mentioned mandrel positions when the internal string pressure (i.e., the pressure inside tool 22) exceeds the string external pressure (i.e., the pressure in annulus 16 immediately outside of tool 22) and for moving the valve mandrel toward the other of the above-mentioned positions when the string external pressure exceeds the internal string pressure. Thus, by alternately pumping down the testing string and then down the annulus, or by otherwise creating an alternating pressure differential between the interior and the exterior of circulation tool 22, the circulation port of tool 22 can be opened and closed as desired.

An embodiment of an internal-external pressure differential operated circulation tool 22 preferred for use in the present invention is depicted in FIGS. 2A–2F, 3, 4, and 5. Circulation tool 22 includes a cylindrical outer housing, generally designated by the numeral 100, having an upper housing adapter 102 which includes threads 104 for attaching tool 22 to the portion of testing string 10 located above tool 22.

At the lower end of housing 100 is a lower housing adapter 106 which includes an externally threaded portion 108 for connecting valve 22 to the portion of test string 10 located below the pool.

Housing 100 includes an upper housing section 110, an intermediate housing section 112 and a lower housing section 114. The interior of the components making up housing 100 form a fluid flow passageway 116 extending longitudinally through tool 22. The various housing sections are threadably connected to one another via threaded connections as shown in the drawing, each such threaded connection being sealed with O-rings as shown.

Figure 2A:
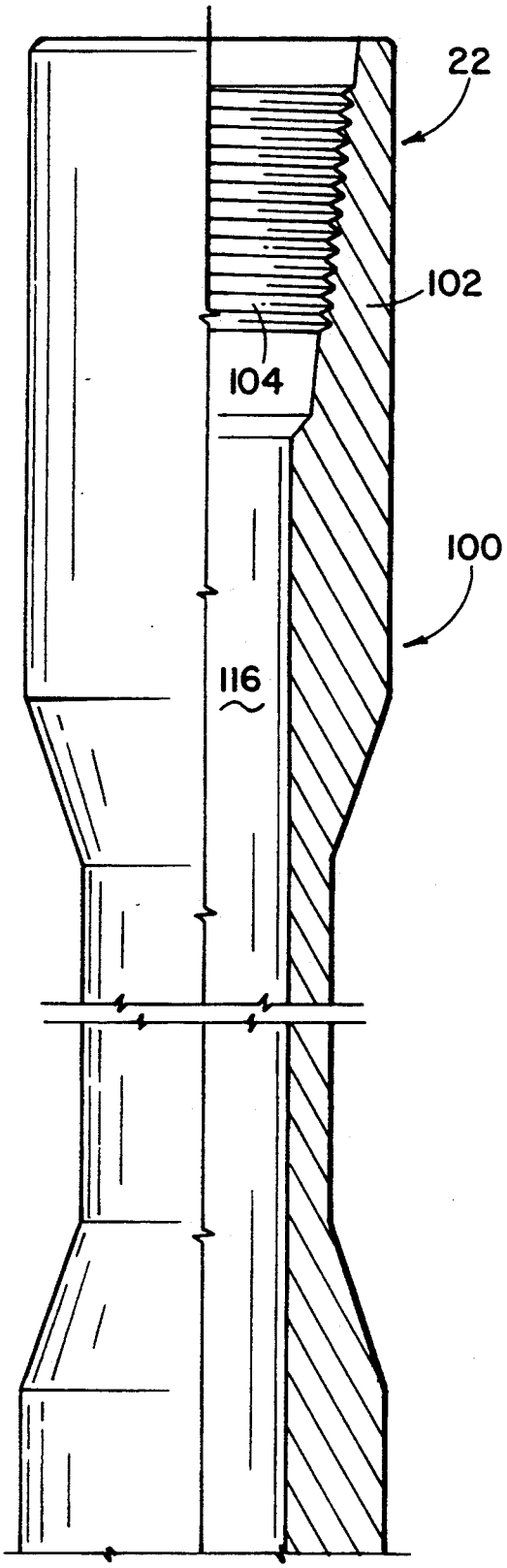
FIGS. 2A–2F provide an elevational sectional view of a circulation tool preferred for use in the present invention.
Figure 2B:
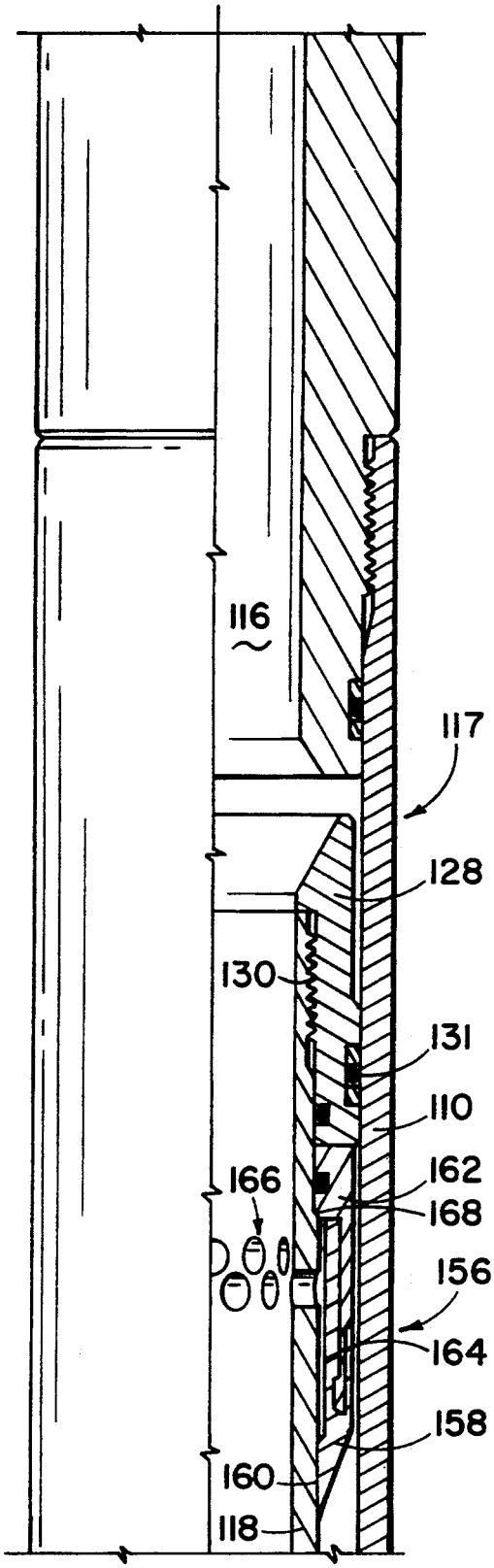
Figure 2C:
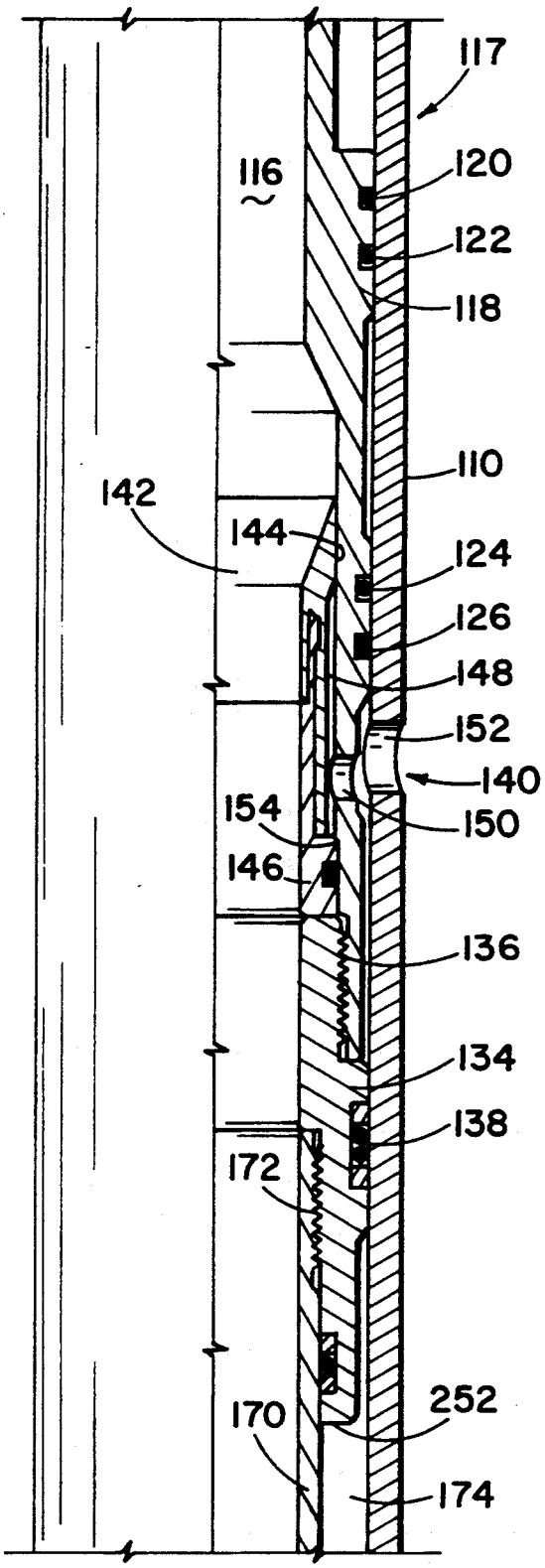

Indicated generally at 117 in FIGS. 2B and 2C is a circulation valve. A generally tubular valve mandrel 118 is closely received within upper housing section 110 and is sealingly engaged therewith via O-rings 120, 122, 124, and 126. An upper valve sleeve 128 is closely received within upper housing section 110 and is threadably engaged via threads 130 to the upper end of valve mandrel 118. An O-ring 131 is sealingly positioned between the radially outer surface of upper valve sleeve 128 and the radially inner surface of upper housing section 110. A lower valve sleeve 134, shown in FIG. 2C, is threadably engaged via threads 136 to the lower end of valve mandrel 118 and is sealingly engaged with upper housing section 110 via O-ring seal 138.

Valve mandrel 118 includes a lower check valve indicated generally at 140. Included therein is a resilient valve portion 142 comprising an annular lip having a radially outer surface 144 which bears against the radially inner surface of valve mandrel 118. Valve portion 142 is inserted over and carried by a valve portion carrier 146. Carrier 146 supports valve portion 142 to create an annular space 148 between the radially outer surface of the valve portion and the radially inner surface of valve mandrel 118. A plurality of bores, one of which is bore 150, are formed through mandrel 118 about the circumference thereof and permit fluid communication between the exterior of the mandrel and space 148. Upper housing section 110 includes a circulating port 152 for permitting fluid communication between the interior and exterior of upper housing section 110.

Valve carrier 146 is received between the upper end of lower valve sleeve 134 and a bevel 154 formed on the radially inner surface of valve mandrel 118 and is thus restrained from axial movement relative to the valve mandrel.

In FIG. 2B, an upper check valve is indicated generally at 156. Included therein is a resilient valve portion 158 having an annular lip which has a radially inner surface 160 that is sealingly engaged against the radially outer surface of valve mandrel 118 about the circumference of valve mandrel 118. Resilient valve portion 158 is carried by a valve portion carrier 162. A space 164 is formed between the radially inner surface of resilient valve portion 158 and the radially outer surface of the valve mandrel.

A plurality of bores 166 about the circumference of valve mandrel 118 provide fluid communication between the interior of the valve mandrel and space 164. Valve carrier 162 is received between the lower end of upper valve sleeve 128 and a bevel 168 formed on the radially outer surface of valve mandrel 118 about its circumference. Thus, valve carrier 162 is restrained from axial movement relative to the valve mandrel.

Figure 2D:
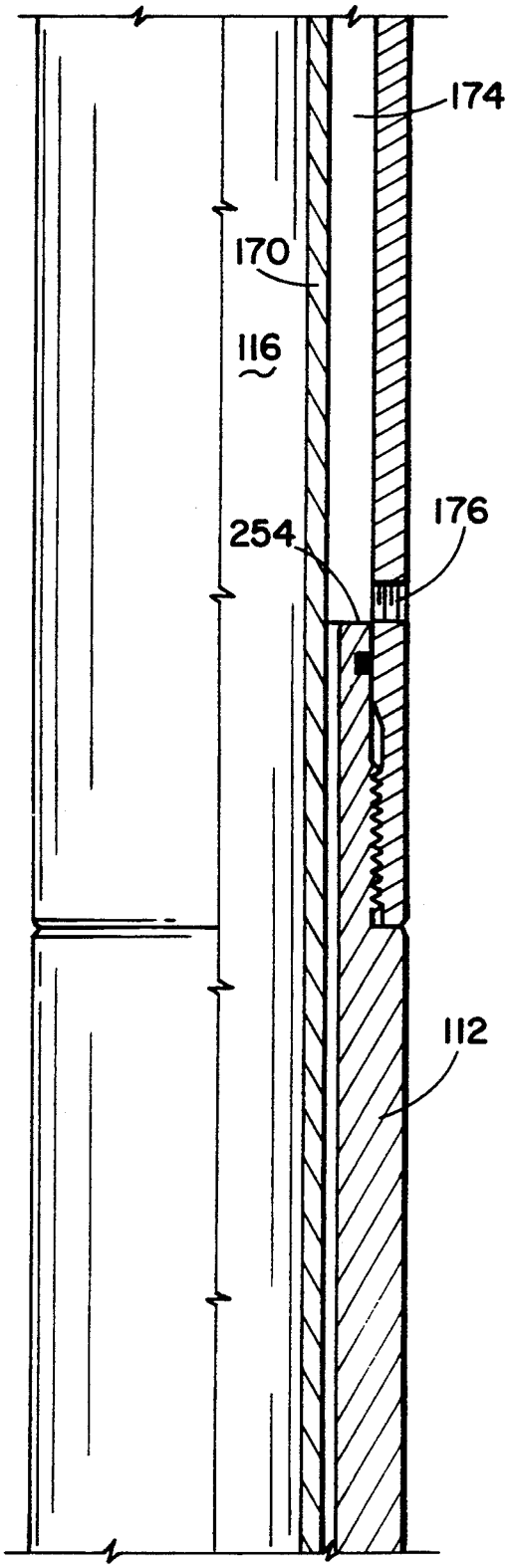
Figure 2E:
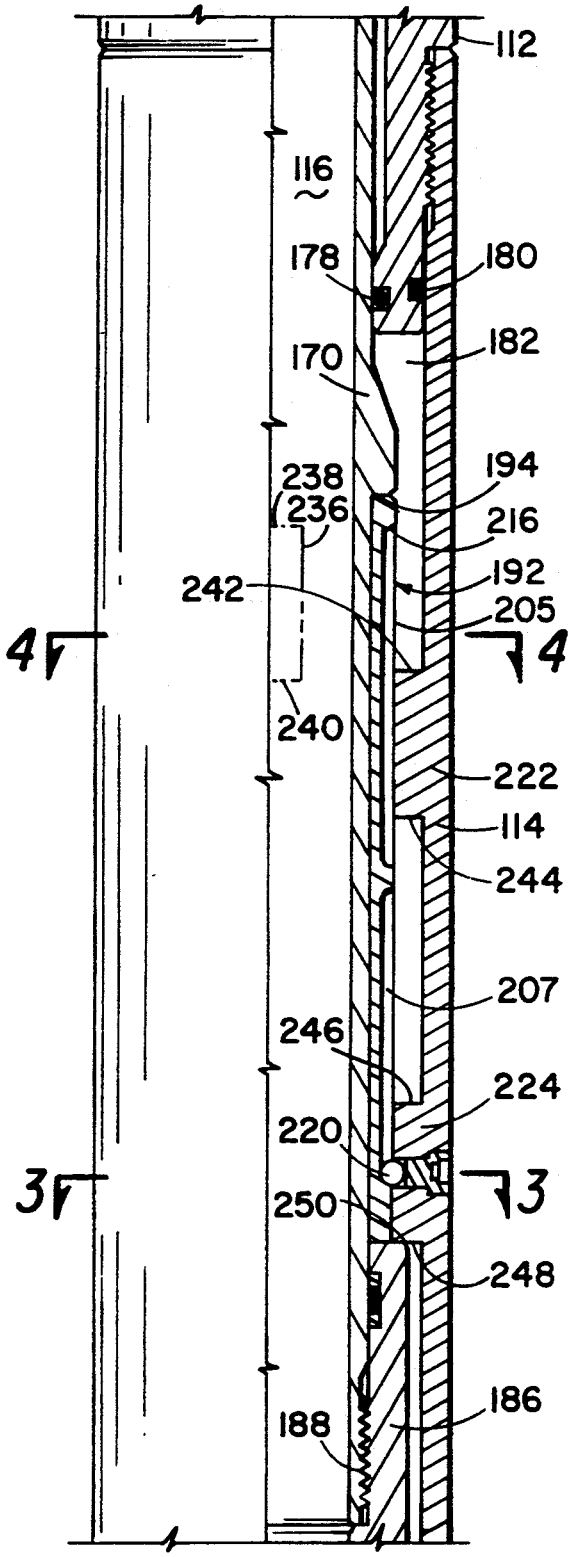
Figure 2F:
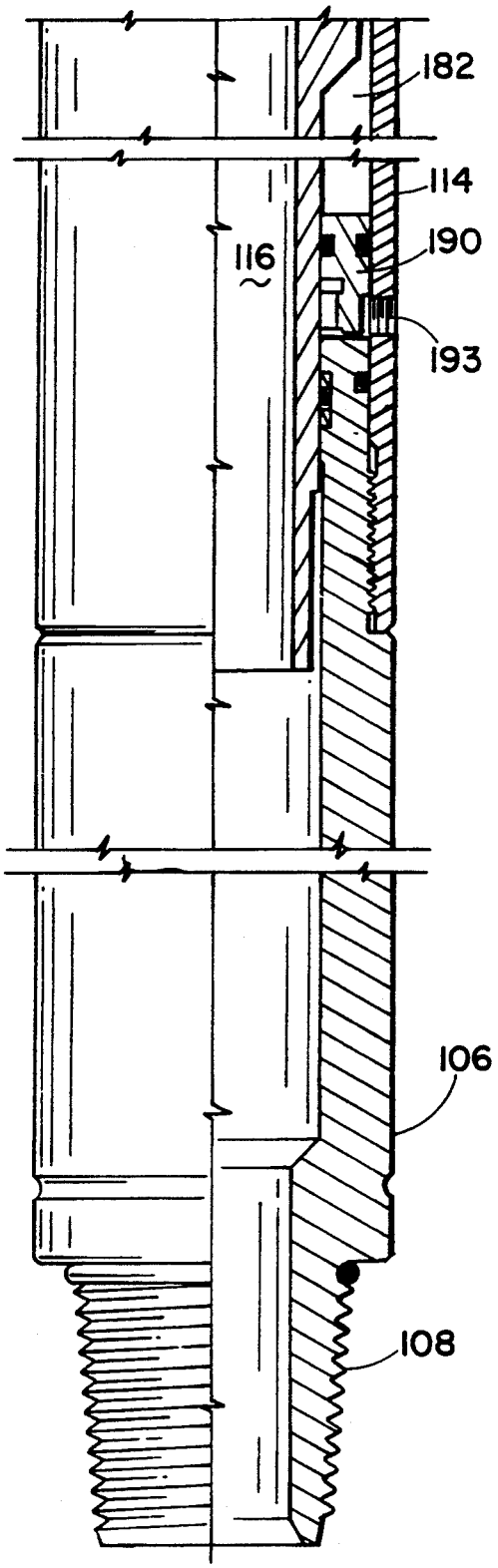
Figure 6A:
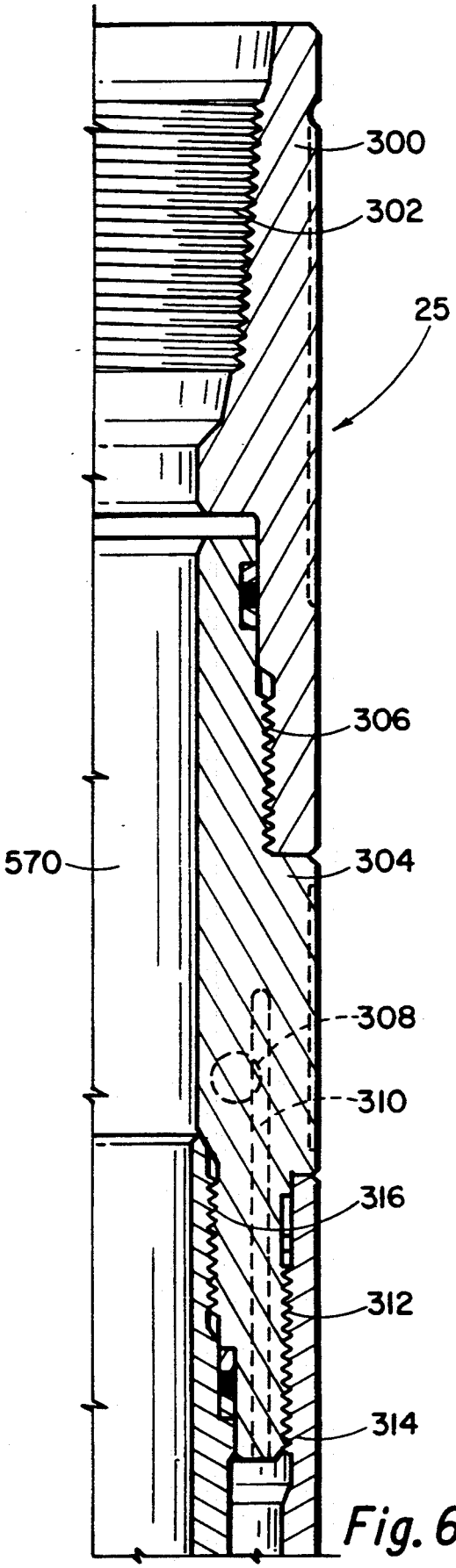
FIGS. 6A–6H provide an elevational sectional view of a drill stem testing tool preferred for use in the present invention.
Figure 6B:
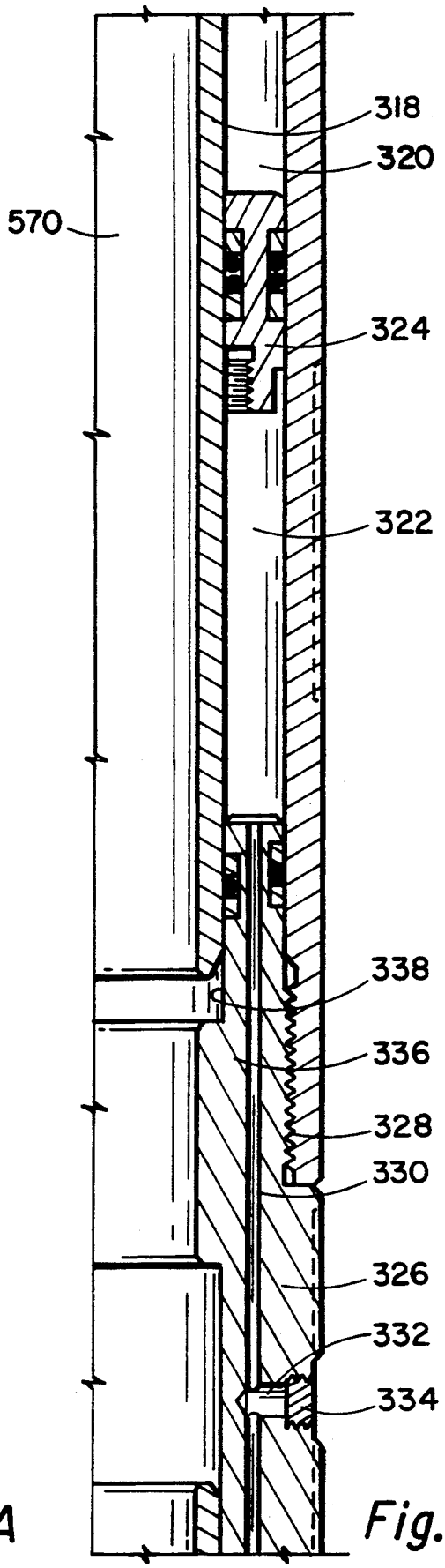
Figure 6C:
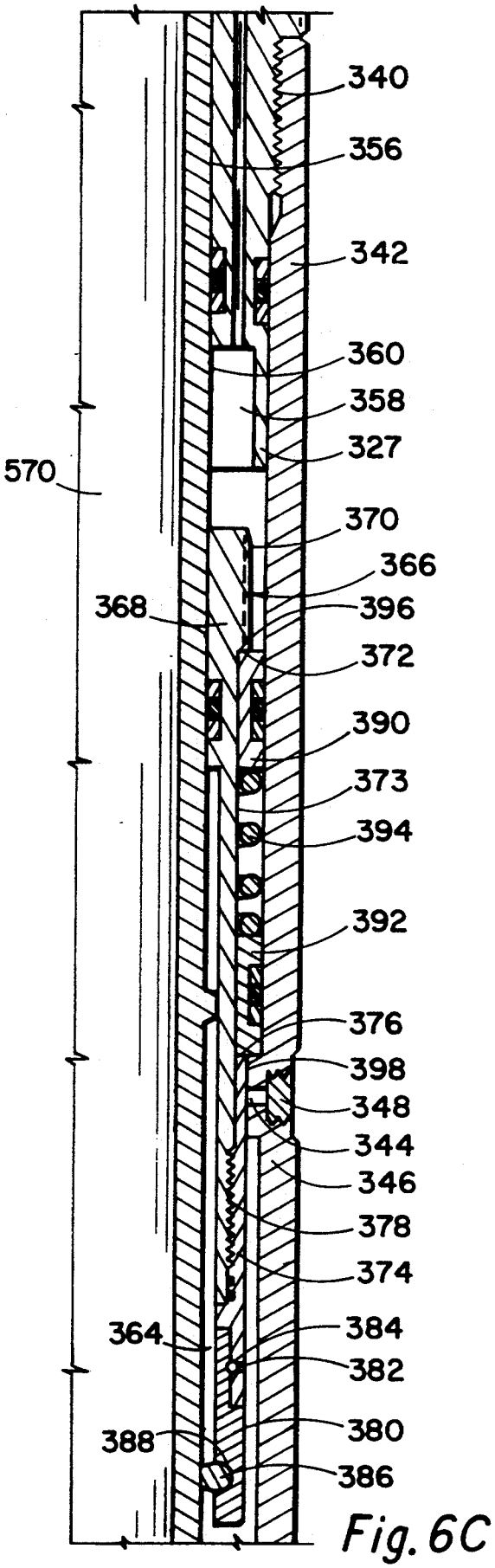
Figure 6D:
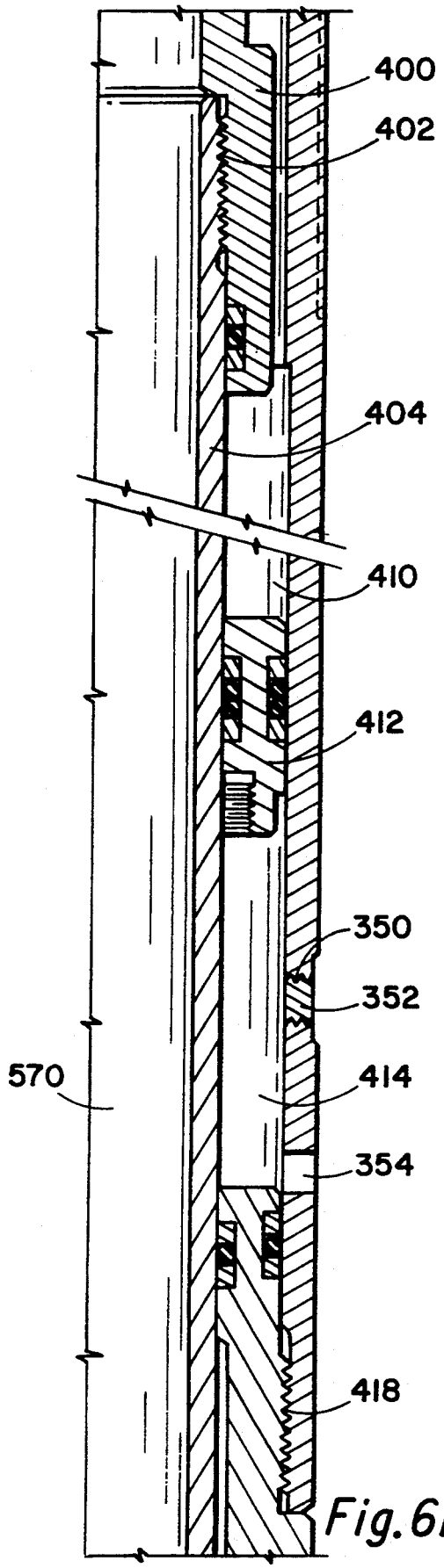
Figure 6E:
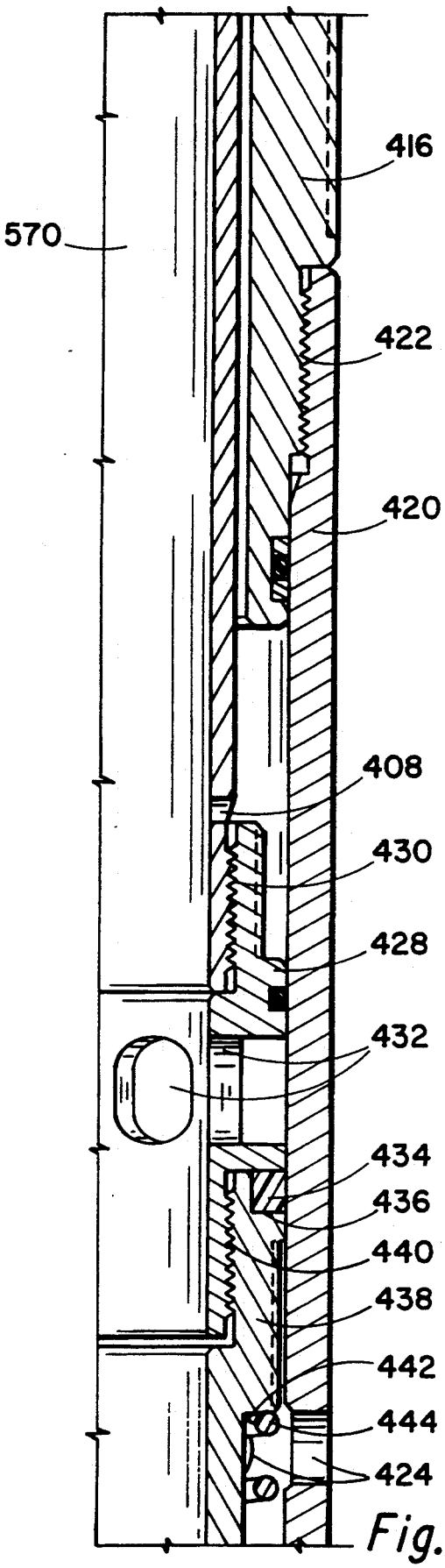
Figure 6F:
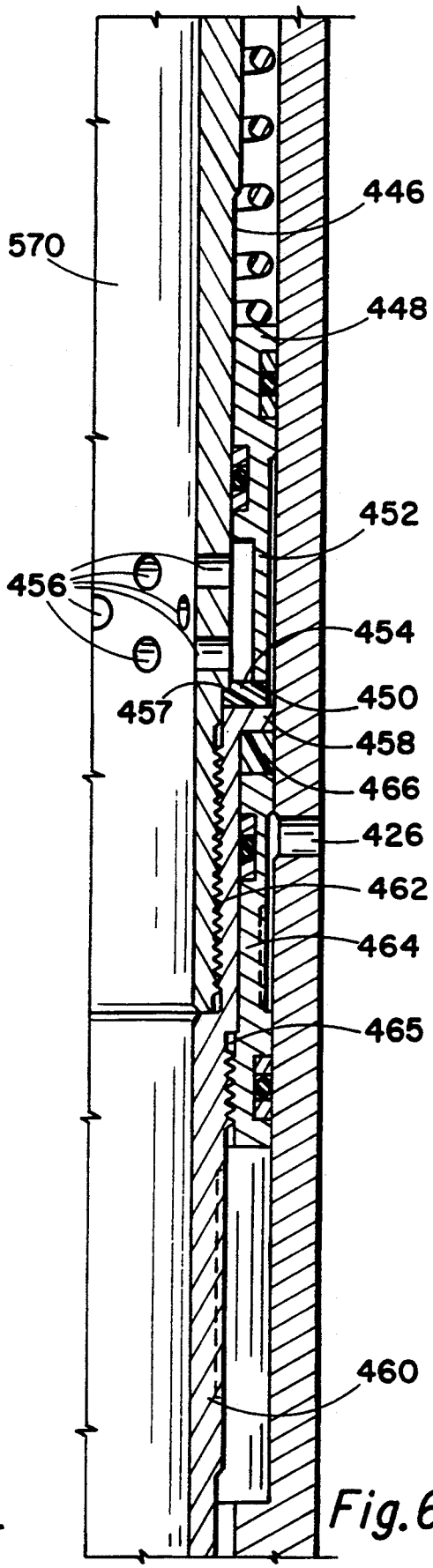
Figure 6G:
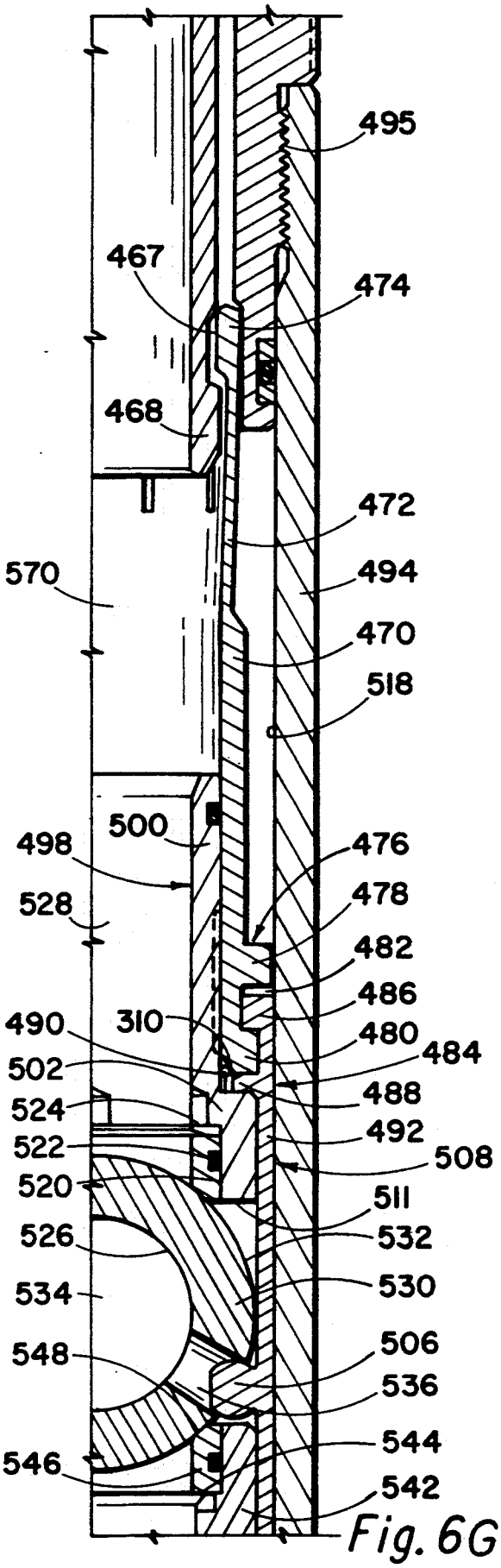
Figure 6H:
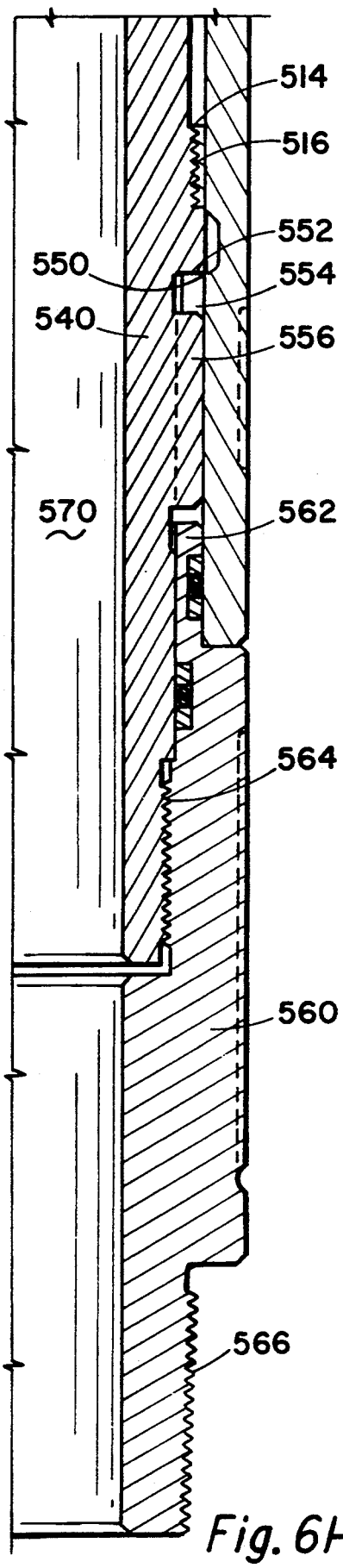

A piston mandrel 170 shown in FIGS. 2C, 2D, and 2E has an upper end threadably secured via threads 172 to the lower end of lower valve sleeve 134. The radially outer surface of piston mandrel 170 and the radially inner surfaces of upper housing section 110 and intermediate housing section 112 define an upper annular space 174 which is in fluid communication with the exterior of the tool via a power port 176. O-rings 178, 180 seal the radially inner and outer surfaces of intermediate housing section 112 and define the lower end of annular space 174. O-rings 178, 180 define the upper end of a lower annular space 182 which has as its outer boundary the radially inner surface of lower housing section 114. The radially inner boundary of space 182 is defined by the outer surface of piston mandrel 170 and by the outer surface of a lower piston mandrel 186 which is threadably secured to the lower end of piston mandrel 170 via threads 188.

Disposed at the lower end of annular space 182 is an annular floating piston 190. Piston 190 is sealingly and slidingly received between the radially outer surface of the lower piston mandrel and the radially inner surface of lower housing section 114. Lower annular space 182 is filled with oil to provide lubrication for various moving parts, which are hereinafter more fully described, contained within space 182. The lower side of floating piston 190 is in fluid communication with the exterior of tool 22 via a port 193 formed through the wall of lower housing section 114. The floating piston prevents drilling mud and other materials contained in the well bore from becoming mixed with the oil contained in the upper portion of annular space 182.

In FIG. 2E, an indexing sleeve 192 is closely received over piston mandrel 170 and is restrained from axial movement therealong by a downward facing shoulder 194 formed on mandrel 170 and by the upper surface of lower piston mandrel 186. For a better view of the structure associated with indexing sleeve 192, attention is directed to FIG. 5.

An outer cylindrical surface 196 on indexing sleeve 192 includes a continuous slot or groove, such being indicated generally at 198. Groove 198 includes a repeating zig-zag portion 200 which rotates sleeve 192 counter-clockwise, as viewed from above, upon reciprocation of piston mandrel 170 relative to housing 100.

Groove 198 further includes first and second vertical groove portions 202(*a*) and (*b*). Each of groove portions 202(*a*) and (*b*) includes an upper leg 205 and a lower leg 207. Connecting groove portions 206 and 208 connect repeating zig-zag portion 200 with vertical groove portions 202(*a*) and (*b*). Zig-zag portion 200 includes a first leg 210 having an upper surface 212 and a lower surface 214. Each of the other legs in zig-zag portion 200 include similar upper and lower surfaces. Likewise, each of vertical grooves 202 includes an upper surface 216 and a lower surface 218.

A ball 220 is biased into groove portion 202(*a*) and more particularly into the lower portion of the groove as viewed in both FIGS. 5 and 2E.

In FIG. 2E, ball 220 is mounted on the radially inner surface of an annular shoulder 224 which is formed on the radially inner surface of lower housing section 114.

An annular shoulder 222 is formed on the radially inner surface of lower housing section 114 about its circumference. Annular shoulder 222 includes a pair of opposed slots 226 and 228 which are viewable in FIG. 4.

Annular shoulder 224 includes a similar pair of opposed slots 230 and 232 with slot 230 being axially aligned with slot 226 and slot 232 being axially aligned with slot 228.

Indexing sleeve 192 includes a pair of opposed load lugs 234 and 236, such being viewable in FIG. 4. In FIG. 4, opposing lugs 234 and 236 are received within slots 226 and 228, respectively. Load lug 236 is viewable in FIG. 5 and is shown in dot-dash lines in FIG. 2E, such indicating load lug 236 positioned on the rear side of index sleeve 192 with lug 234 being half cut away in the quarter section and half obscured by lower housing section 114. Load lug 236 includes an upper abutment surface 238 and a lower abutment surface 240.

As shown in FIG. 2E, annular shoulder 222 includes upper abutment surface 242 and lower abutment surface 244.

As also shown in FIG. 2E, shoulder 224 includes upper abutment surface 246 and lower abutment surface 248. The upper surface of lower piston mandrel 286 comprises an abutment surface 250 which is abutted against surface 248 in the view of FIG. 2E.

The creation, by pumping or by other means, of alternating pressure differentials between the interior and the exterior of tool 22 will cause valve mandrel 118, upper valve sleeve 128, lower valve sleeve 134, piston mandrel 170, indexing sleeve 192, and lower piston mandrel 186 to reciprocate longitudinally inside, and relative to, housing 100. As indexing sleeve 192 reciprocates in housing 100, ball 220, which remains in fixed position relative to housing 100, operates in groove 198 of sleeve 192 to cause sleeve 192 to rotate about piston mandrel 170. The various abutment surfaces (e.g., 238, 240, 242, 244, 246, 248, 250, 252, and 254) provided in tool 22 interact, in conjunction with the rotation of indexing sleeve 192, to (a) stop the longitudinal movement of valve mandrel 118, valve sleeves 128 and 134, piston mandrels 170 and 186, and indexing sleeve 192 before ball 220 abuts the end surfaces (e.g., 212, 214, 216, and 218) of groove 198 and to (b) control the longitudinal positioning of valve mandrel 118 so that an operator, through the use of a predetermined number of interior-exterior differential pressure reversals, can place tool 22 in a forward circulation mode, in a reverse circulation mode, or in a closed mode.

Using the internal-external differential pressure operated circulation tool 22 of FIGS. 2–5, an operator can selectively spot fluid down the well or reverse circulate fluid from the annulus to the interior of test string 10. If desired, the operator can also apply drill string pressure and/or annulus pressure, in order to pump fluids and/or actuate other downhole tools, without changing the operating mode of circulation tool 22.

A full discussion of the structure and operation of the tool 22 depicted in FIGS. 2–5 is provided in U.S. Pat. No. 4,657,082, the entire disclosure of which is incorporated herein by reference.

The Annulus Pressure Operated Drill Stem Tester Tool

The annulus pressure operated drill stem tester tool 25 used in the instant invention generally comprises: a cylindrical housing which defines a bore extending longitudinally through tool 25; a bore closure valve; and an operating means, responsive to external (i.e., well bore annulus) pressure changes, for selectively opening and closing the bore closure valve.

A drill stem tester tool 25 preferred for use in the instant invention is shown in FIGS. 6A–6H and 7. An upper adapter 300 having threads 302 therein is provided at the upper end of drill stem tester tool 25 for securing tool 25 to the portion of testing string 10 located above tool 25. Upper adapter 300 is secured to nitrogen valve housing 304 at threaded connection 306. Housing 304 contains a valve assembly (not shown), such as is well known in the art, in lateral bore 308. Lateral bore 308 extends into the wall of housing 304. Nitrogen charging channel 310 extends downwardly from lateral bore 308.

Housing 304 is secured by threaded connection 312 at its outer lower end to tubular pressure case 314 and by threaded connection 316 at its inner lower end to gas chamber mandrel 318. Case 314 and mandrel 318 define a pressurized gas chamber 320 and an upper oil chamber 322. Chamber 320 and chamber 322 are separated by floating annular piston 324.

The upper end of an oil channel coupling 326 extends between case 314 and gas chamber mandrel 318 and is secured to the lower end of case 314 at threaded connection 328. A plurality of longitudinal oil channels 330 (one shown) extend from the upper end of coupling 326 to the lower end thereof. Radially drilled oil fill ports 332 extend from the exterior of tool 25, intersect channels 330, and are closed with plugs 334. Annular shoulder 336 extends radially inward from inner wall 338 of coupling 326. The lower end of coupling 326, which includes annular overshot 327, is secured at threaded connection 340 to the upper end of ratchet case 342. Oil fill ports 344 extend through ratchet case 342 at annular shoulder 346 and are closed by plugs 348. At the lower end of ratchet case 342 are open pressure ports 354 and additional oil fill ports 350, said oil fill ports 350 being closed by plugs 352.

Ratchet slot mandrel 356 extends upward within the lower end of oil channel coupling 326. Annular ratchet chamber 358 is defined between mandrel 356 and case 342. The upper exterior 360 of mandrel 356 is of substantially uniform diameter. The lower exterior 362 of mandrel 356 is of greater diameter than upper exterior 360 whereby sufficient wall thickness is provided for ratchet slots 364. There are preferably two ratchet slots 364 of the configuration shown in FIG. 7 extending about the exterior of ratchet slot mandrel 356.

Ball sleeve assembly 366 surrounds ratchet slot mandrel 356 and includes upper sleeve 368. Upper sleeve 368 includes radially outwardly extending annular shoulder 370 having annular piston seat 372 thereon. Below shoulder 370, ratchet piston support surface 373 extends to the lower end of upper sleeve 368. The lower end of upper sleeve 368 is overshot by the upper end of lower sleeve 374 having annular piston seat 376 thereon. Upper sleeve 368 is secured to lower sleeve 374 by threaded connection 378. Ball sleeve 380 is disposed at the bottom of lower sleeve 374 and is secured thereto at swivel bearing race 382 by a plurality of bearings 384. Ratchet ball 386 extends into ball seat 388 of ball sleeve 380 and into ratchet slot 364. A second ratchet ball (not shown) is likewise disposed in a position diametrically opposite ball 386. When balls 386 follow the path of slots 364, ball sleeve 380 rotates with respect to lower sleeve 374. The remainder of ball sleeve assembly 366 does not rotate, however, so that only longitudinal movement is transmitted to ratchet mandrel 356 by balls 386.

Upper annular ratchet piston 390 and lower annular ratchet piston 392 ride on piston support surface 373 of upper sleeve 368. Coil spring 394 is disposed between piston 390 and piston 392. Upper ratchet piston 390 carries radial sealing surface 396 on its upper end while lower ratchet piston 392 carries radial sealing surface 398 on its lower end.

The lower end 400 of ratchet slot mandrel 356 is secured at threaded connection 402 to extension mandrel 404 having relief ports 408 extending therethrough. Annular lower oil chamber 410 is defined by ratchet case 342 and extension mandrel 404. Annular floating piston 412 slidingly seals the bottom of lower oil chamber 410 and divides it from well fluid chamber 414 into which pressure ports 354 open. The lower end of ratchet case 342 is secured at threaded connection 418 to extension case 416 surrounding extension mandrel 404.

Circulation-displacement housing 420 is threaded at 422 to extension case 416 and possesses a plurality of circumferentially spaced radially extending circulation ports 424 and a plurality of nitrogen displacement ports 426. Ports 424 and 426 extend through the wall of housing 420.

Circulation valve sleeve 428 is threaded to extension mandrel 404 at 430. Valve apertures 432 extend through the wall of sleeve 428 and are isolated from circulation ports 424 by annular seal 434. Seal 434 is disposed in seal recess 436 formed by the junction of circulation valve sleeve 428 and displacement valve sleeve 438. Sleeves 428 and 438 are joined at threaded connection 440. The exterior of displacement valve sleeve 438 carries thereon downwardly facing radially extending annular shoulder 442, against which bears displacement spring 444. The lower exterior of displacement valve sleeve 438 is defined by displacement piston surface 446 upon which sliding annular displacement piston 448 rides. Annular valve surface 450 of piston 448 seats on elastomeric valve seat 454. Nitrogen displacement apertures 456 extend through the wall of displacement valve sleeve 438. Valve seat 454 is pinched between sleeve 438, shoulder 457 of sleeve 438, and flange 458 of operating mandrel 460. Operating mandrel 460 is secured to sleeve 438 at threaded connection 462.

Seal carrier 464 surrounds mandrel 460 at the junction of mandrel 460 with sleeve 438 and is secured to mandrel 460 at threaded connection 465. Square cross-section annular seal 466 is carried on the exterior of mandrel 460 adjacent flange 458 and is secured in place by the upper end of seal carrier 464.

Below seal carrier 464, mandrel 460 extends downwardly to exterior annular recess 467 which separates annular shoulder 468 from the main body of mandrel 460.

Collet sleeve 470, having collet fingers 472 extending upwardly therefrom, engages operating mandrel 460 through the accommodation of radially inwardly extending protuberances 474 in annular recess 467. As is readily noted in FIG. 6G, protuberances 474 on the upper portions of fingers 472 are confined between the exterior of mandrel 460 and the interior of circulation-displacement housing 420.

At the lower end of collet sleeve 470, coupling 476, comprising flanges 478 and 480 with exterior annular recess 482 therebetween, grips couplings 484 of ball operating arms 492. Each coupling 484 comprises inwardly extending flanges 486 and 488 with interior recesses 490 formed therebetween. Couplings 476 and 484 are maintained in engagement by their location in annular recess 496 between ball case 494, which is threaded at 495 to circulation-displacement housing 420, and ball housing 498. Ball housing 498 is of substantially tubular configuration. Ball housing 498 has an upper, smaller diameter portion 500 and a lower, larger diameter portion 502. Lower portion 502 has two windows 504 cut through the wall thereof to accommodate the inward protrusion of lugs 506 from each of the two ball operating arms 492. Windows 504 extend from shoulder 511 downward to shoulder 514 adjacent threaded connection 516. On the exterior of the ball housing 498, two longitudinal channels (location shown by arrow 508) of arcuate cross-section and aligned with windows 504 extend from shoulder 510 downward to shoulder 511. Ball operating arms 492, which are of substantially the same arcuate cross-section as channels 508, lie in channels 508 and across windows 504 and are maintained in place by the interior wall 518 of ball case 494 and the exterior of ball support 540.

The interior of ball housing 498 possesses upper annular seat recess 520, within which annular ball seat 522 is disposed. Ball seat 522 is biased downwardly against ball 530 by ring spring 524. Surface 526 of upper seat 522 comprises a metal sealing surface and provides a sliding seal with the exterior 532 of valve ball 530.

Valve ball 530 includes a diametrical bore 534 extending therethrough of substantially the same diameter as bore 528 of ball housing 498. Two lug recesses 536 extend from the exterior 532 of valve ball 530 to bore 534.

The upper end 542 of ball support 540 extends into ball housing 498 and carries lower ball seat recess 544 in which annular lower ball seat 546 is disposed. Lower ball seat 546 possesses arcuate metal sealing surface 348 which slidingly seals against the exterior 532 of valve ball 530. When ball housing 498 is made up with ball support 540, upper and lower ball seats 522 and 546 are biased into sealing engagement with valve ball 530 by spring 524.

Exterior annular shoulder 550 on ball support 540 is contacted by the upper ends 552 of splines 554 on the interior of ball case 494, whereby the assembly of ball housing 494, ball operating arms 492, valve ball 530, ball seats 522 and 546 and spring 524 are maintained in position inside ball case 494. Splines 554 engage splines 556 on the exterior of ball support 540 and thus prevent ball support 540 and ball housing 498 from rotating within ball case 498.

Lower adapter 560 sealingly protrudes at its upper end 562 between ball case 498 and ball support 540 when made up with ball support 540 at threaded connection 564. The lower end of lower adapter 560 includes exterior threads 566 for making up with the portion of the testing string positioned below drill stem tester tool 25.

When valve ball 530 is in its open position, a "full open" bore 570 extends throughout tool 50, thus providing an unimpeded path for formation fluids flow and/or the travel of perforating guns, wireline instrumentation, etc.

In accordance with the present invention, and as explained more fully hereinbelow, drill pipe tester tool 25 is preferably run into well bore 3 in its drill pipe tester mode. The drill pipe tester mode of tool 25 is depicted in FIGS. 6A–6H. In the drill pipe tester mode, ball 530 is in its closed position (i.e., ball bore 534 is perpendicular to tool bore 570) and circulation ports 424 are misaligned with circulation apertures 432, seal 434 preventing fluid communication between ports 424 and apertures 432, and nitrogen displacement ports 426 are offset from displacement apertures 456, seal 466 preventing fluid communication between ports 426 and apertures 456. Further, balls 386 are located in positions "a" in slots 364.

As tool 25 travels down well bore 3 toward formation 5, the hydrostatic pressure outside of tool 25 increases, thus forcing floating piston 412 upward. Consequently, ball sleeve assembly 366 is also forced upward and balls 386 are caused to move to positions "b". The movement of balls 386 from positions "a" to positions "b" does not change the operating mode of tool 25.

When drill stem testing tool 25 is positioned in well bore 3, as depicted in FIG. 1, an increase in well annular pressure acts through pressure port 354 to push annular floating piston 412 upward, thus increasing the fluid pressure in oil chamber 410 and in the lower portion of ratchet chamber 358 (i.e., beneath ratchet piston 390). The increased fluid pressure beneath piston 390 moves piston 390 upward until piston 390 abuts overshot 327. As piston 390 travels upward, piston 390 pushes against seal surface 396 of shoulder 370 and thus forces sleeve 368 upward. When piston 390 abuts overshot 327, the high pressure fluid beneath piston 390 and shoulder 370 continues to push sleeve 368 upward such that shoulder 370 separates from piston 390. This separation allows fluid to flow around piston 390 and sleeve 368 so that the pressure across sleeve 368 is equalized and the upward movement of sleeve 368 ceases.

The upward movement of piston 390 and sleeve 368 and the flow of high pressure fluid between piston 390 and sleeve 368 operate to increase the fluid pressure existing in oil channels 330 and in upper oil chamber 322. The resulting high pressure condition created in upper oil chamber 322 forces floating annular piston 324 upward and thus compresses the gas contained in pressurized gas chamber 320.

When the pressure in well bore annulus 16 is reduced, whether by releasing the pressure exerted by pump 15 or by other means, the pressure inside well fluid chamber 414 becomes less than the pressure of the compressed gas contained in pressurized gas chamber 320. Thus, the compressed gas in chamber 320 pushes floating annular piston 324 downward. The downward movement of piston 324 compresses (i.e., increases the pressure of) the fluid in upper oil chamber 322, in oil channels 330, and in ratchet chamber 358 above lower ratchet piston 392. Consequently, piston 392 is pushed downward until piston 392 abuts annular shoulder 346. As piston 392 moves downward, it abuts against seal surface 398 and thus pushes ball sleeve assembly 366 downward. When piston 392 abuts against annular shoulder 346, the high pressure fluid above piston 392 continues to push ball sleeve assembly 366 downward so that seal surface 398 separates from piston 392, a portion of the fluid above piston 392 flows around piston 392, the pressure across ball sleeve assembly 366 is thus equalized, and the downward movement of ball sleeve assembly 366 ceases.

Figure 7:
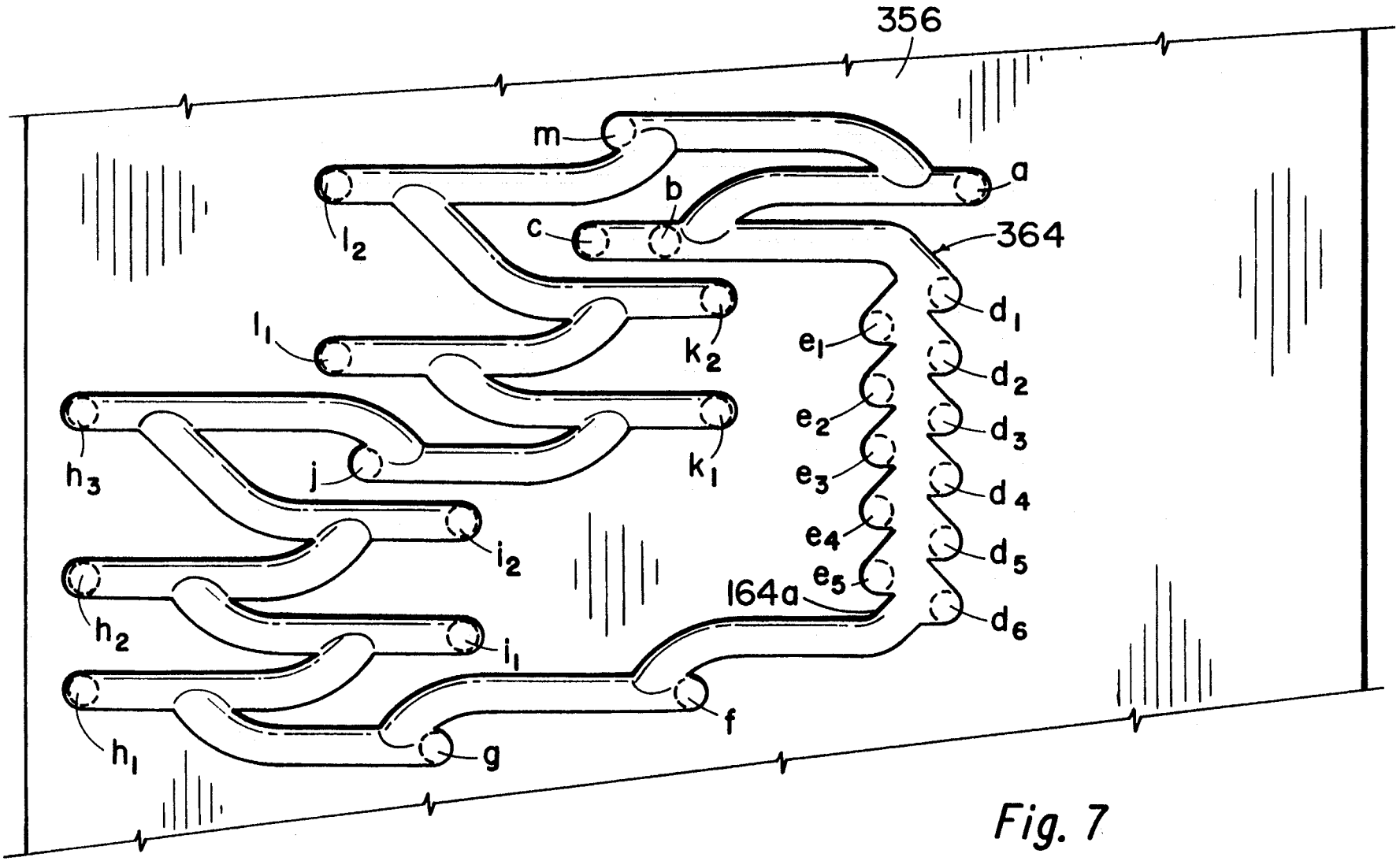
FIG. 7 provides a view of a preferred rachet ball slot layout used in the drill stem testing tool of FIGS. 6A–6H.
Figure 8A:
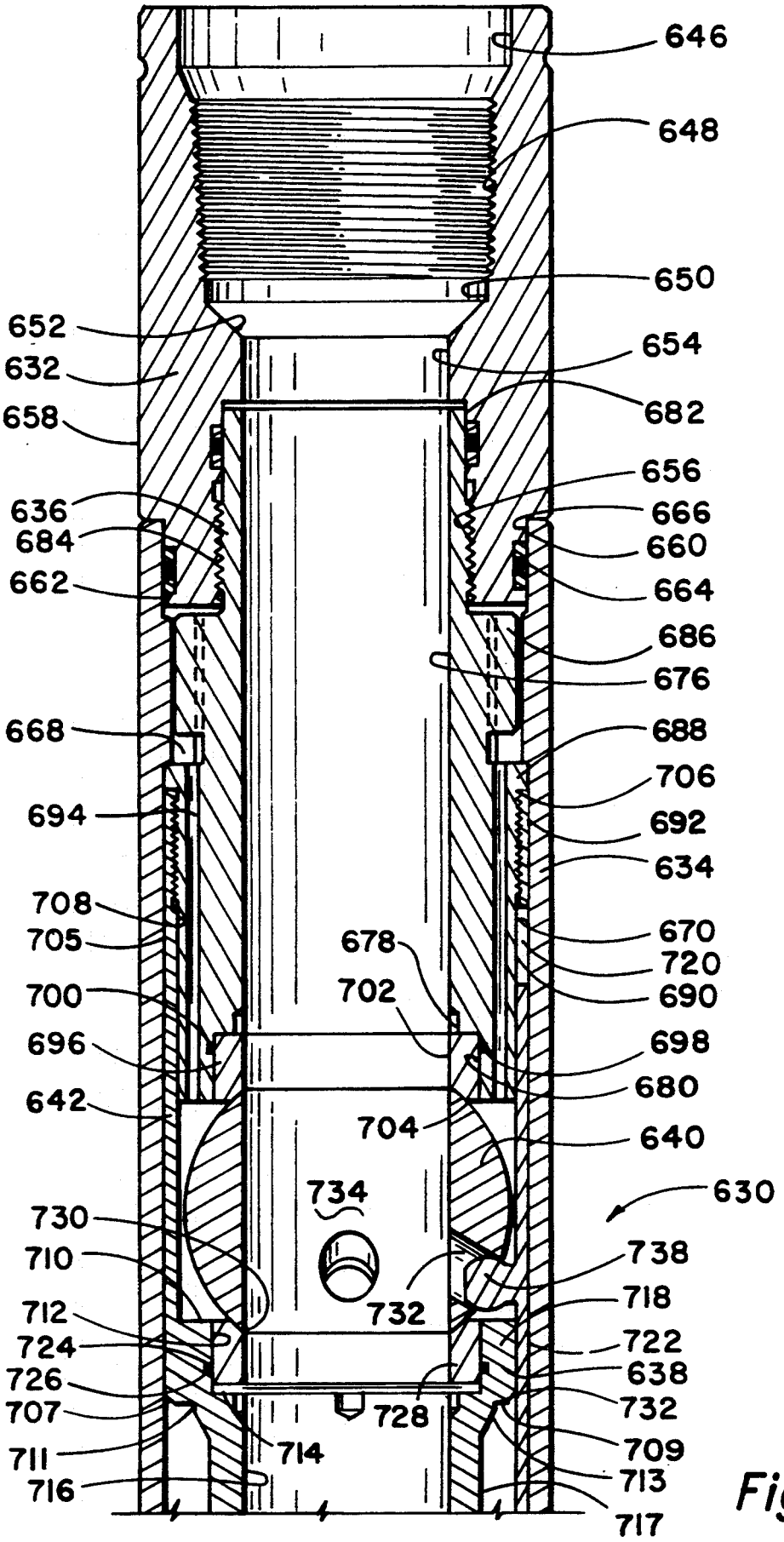
FIGS. 8A–BE provide an elevational sectional view of a formation testing tool preferred for use in the present invention.
Figure 8B:
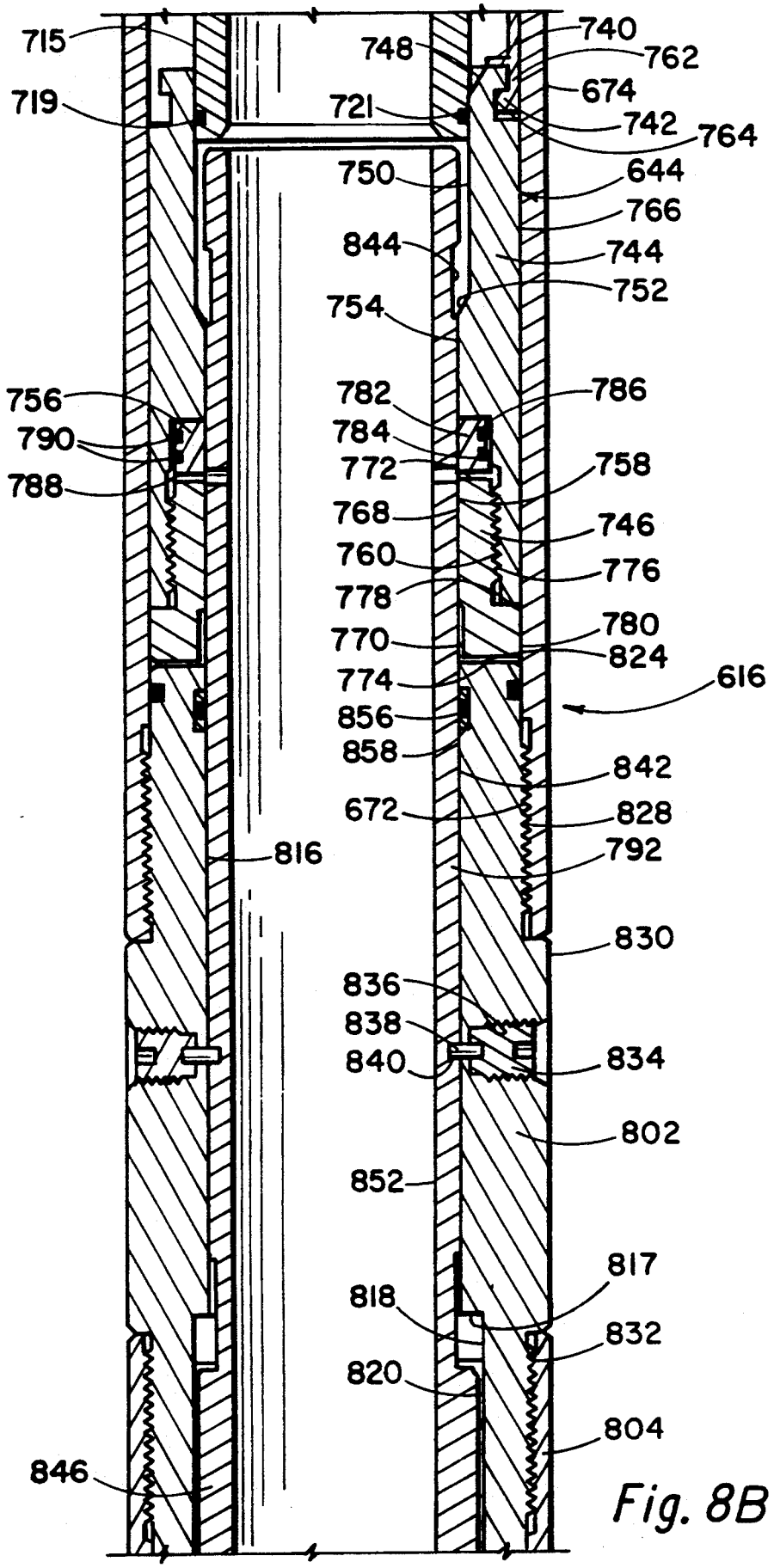
Figure 8C:
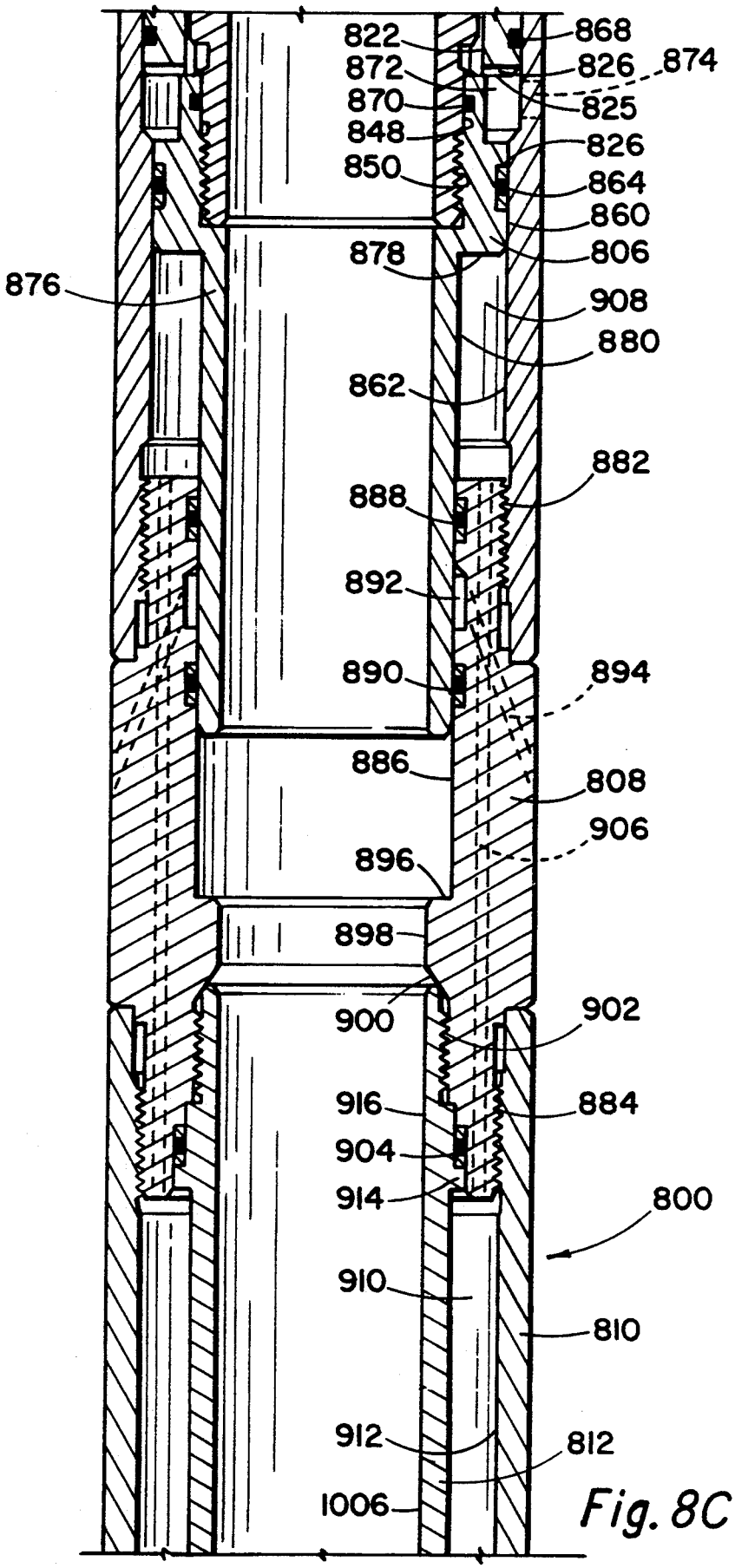
Figure 8D:
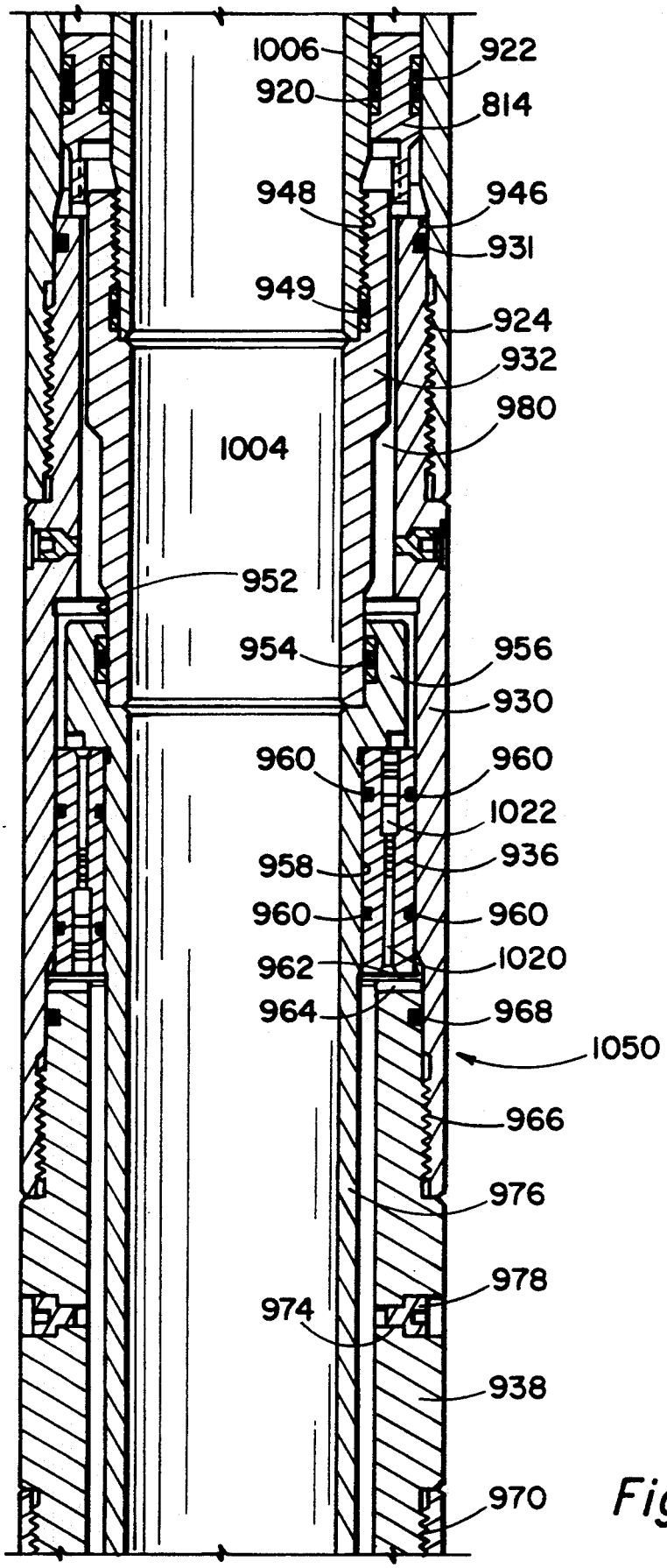
Figure 8E:
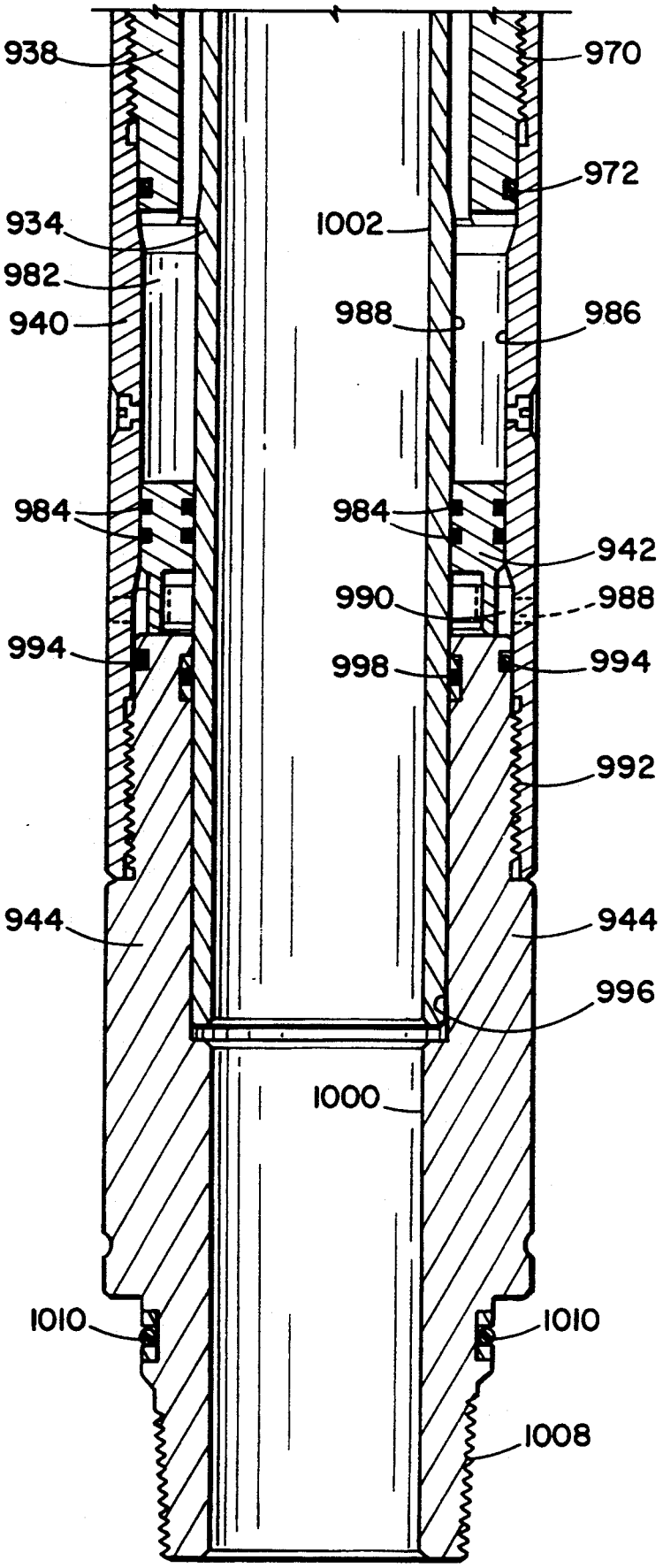

As ball sleeve assembly 366 is forced upward and downward in response to annulus pressure changes, ball sleeve assembly 366 carries ratchet ball 380 upward and downward within the continuous ratchet slot 364 provided in ratchet slot mandrel 356. As ball 380 moves upward and downward in ratchet slot 364, ratchet slot mandrel 356 remains stationary until ball 380 reaches a position in slot 364 where ball 380 is allowed to abut an end surface of slot 364. As shown in FIG. 7, ball 380 is caused to abut an end surface of slot 364 when ball 380 moves to any of positions $d_1$–$d_6$, $e_1$–$e_5$, f, g, j, or m. When ball 380 abuts an end surface of slot 364, ball 380 is "shouldered" against the end surface so that ball sleeve assembly 366, by means of ball 380, carries ratchet slot mandrel 356 longitudinally for the remainder of the ball sleeve assembly's upward or downward stroke. As is readily apparent, each longitudinal movement of ratchet slot mandrel 356 is accompanied by a simultaneous and identical longitudinal movement of extension mandrel 404, circulation valve sleeve 428, displacement valve sleeve 438, and operating mandrel 460.

When ratchet slot mandrel 356 is located at or near its uppermost longitudinal position in tool 25, protuberances 474 of collet fingers 472 are engaged in recess 467 of operating mandrel 460. Thus, as ball sleeve assembly 366 and ball 380 force ratchet slot mandrel 356 to move longitudinally downward from its uppermost position, operating mandrel 460, collet sleeve 470, and ball operating arms 492 also move downwardly so that valve ball 530 is rotated from its open position to its closed position. When valve ball 530 reaches its closed position, protuberances 474 of collet fingers 472 disengage from operating mandrel 460 so that collet sleeve 470 and ball operating arms 492 will not move with operating mandrel 460 thereafter unless annular recess 467 is positioned at the same longitudinal location as protuberances 474 and operating mandrel 460 is then pulled further upward by ratchet slot mandrel 356.

When ball valve 530 is closed, a further downward movement of ratchet slot mandrel 356 will push nitrogen displacement apertures 456 to a position adjacent nitrogen displacement ports 426. In this position, fluid can be pumped from tool bore 570, through apertures 456 and ports 426, and into well bore annulus 16. However, fluid is not allowed to flow from well bore annulus 16 into tool bore 570 when operating in this mode due to the action of a check valve means (i.e., sliding annular displacement piston 448 combined with displacement spring 424) positioned between displacement valve sleeve 438 and circulation housing 420.

With the nitrogen displacement valve open (i.e., with apertures 456 in forward fluid communication with ports 426), a further downward movement of ratchet slot mandrel 400 will push nitrogen displacement apertures 456 downward out of fluid communication with nitrogen displacement ports 426 and will push circulation valve apertures 432 into fluid communication with circulation ports 424. When the circulation valve is open (i.e., when apertures 432 are in fluid communication with ports 424), fluid may be pumped from well bore annulus 16 to tool bore 570 or from tool bore 570 to well bore annulus 16.

When the circulation valve is open, a subsequent movement of ratchet slot mandrel 400 to its uppermost longitudinal position in tool 25 will operate to (a) close the circulation valve and open the nitrogen displacement valve, then (b) close the nitrogen displacement valve, and then (c) open the tool bore closure valve.

As is apparent, tool 25 of FIGS. 6A–6H and 7 operates in a manner such that, by alternately increasing and then decreasing the pressure in the well bore annulus a predetermined number of times or by alternately decreasing and then increasing the pressure in the well bore annulus a predetermined number of times, an operator can selectively and individually open and close any one of the valves of tool 25.

A more detailed description of the structure and operation of the annulus pressure operated drill stem testing tool 25 depicted in FIGS. 6A–6H and 7 is provided in U.S. Pat. No. 4,633,952, the entire disclosure of which is incorporated herein by reference. U.S. Pat. No. 4,633,952 also describes other drill stem testing tool embodiments which are well suited for use in the present invention.

The Annulus Pressure Operated Formation Tester Tool

A formation tester tool 29 preferred for use in the instant invention is shown in FIGS. 8A–8E. Tester tool 29 comprises a valve section 630, a power section 800, and a metering section 1100.

Valve section 630 comprises a top adapter 632, a valve case 634, an upper valve support 636, a lower valve support 638, a ball valve 640, a ball valve actuating arms 642, and a lost-motion actuation sleeve assembly 644.

The adapter 632 comprises a cylindrical elongated annular member including a first bore 646, a first threaded bore 648 of smaller diameter than bore 646, a second bore 650 of smaller diameter than bore 648, an annular chamfered surface 652, a third bore 654 which is smaller in diameter than bore 650, a second threaded bore 656 of larger diameter than bore 654, a first cylindrical exterior portion 658, and a second cylindrical exterior portion 660 which is of smaller diameter than portion 658 and which contains annular seal cavity 662 having seal means 664 therein.

Valve case 634 comprises a cylindrical elongated annular member including a first bore 666, a plurality of internal lug means 668 circumferentially spaced about the interior of valve case 634 near the upper end thereof, a second bore 670 which is of substantially the same diameter as bore 666, a threaded bore 672 and a cylindrical exterior surface 674. Bore 666 sealingly engages second cylindrical exterior portion 660 of adapter 632.

Upper valve seat holder 636 comprises a cylindrical elongated annular member including a first bore 676, an annular recess 678, a second bore 680 of larger diameter then bore 676, a second bore 680, an annular groove 698 holding a seal ring 700, a first cylindrical exterior portion 682, an exterior threaded portion 684, a plurality of lugs 686 circumferentially spaced about the exterior of upper valve seat holder 636, which lugs 686 are received between the plurality of internal lug means 668 circumferentially spaced about the interior of case 634, an annular shoulder 688, and a second cylindrical exterior portion 690 including threads 692 and having longitudinal vent passages therethrough. Received within second bore 680 of upper valve seat holder 636 is a valve seat 696 having bore 702 therethrough and having a spherical surface 704 on the lower end thereof.

Ball valve cage 638 comprises an elongated tubular cylindrical member including a first threaded bore 706, a second smooth bore 708 of substantially the same diameter as bore 706, a radially flat annular wall 710, a third bore 712 of smaller diameter than second bore 708, an annular shoulder 714, and a fourth bore 716 of smaller diameter than third bore 712. Longitudinally elongated windows 720 extend through the wall of ball valve cage 638 from the upper end of second smooth bore 708 to wall 710, whereat the windows 720 extend into arcuate longitudinally extending recesses 722. Received within third bore 712 of ball valve cage 638 is valve seat 718 having bore 728 therethrough and having spherical surface 730 at the upper end thereof. An elastomeric seal 724 resides in an annular recess 726 in the wall of third bore 712. Belleville springs 732 bias valve seat 718 against ball valve 640.

The exterior of ball valve cage 638 comprises a first exterior cylindrical portion 705, a chamfered surface 707, a radial wall 709, an annular edge 711, a tapered surface 713, and a second exterior cylindrical surface 715 having flats 717 thereon and annular recess 719 therein. Disposed in recess 719 is a seal means 721.

Ball valve cage 638 is secured to upper valve seat holder 636 by means of threaded first bore 706 engaging threads 692. The upper portion of ball valve cage 638 encompasses exterior portion 690 of valve seat holder 636. Flats 717 serve as application points for make-up torque.

Contained between upper valve seat support 636 and ball valve cage 638 is ball valve 640 having a central bore 734 extending therethrough and a plurality of cylindrical recesses 732 extending from bore 734 to the exterior thereof.

Ball valve 640 is actuated by means of a plurality of arms 642 connected to a lost-motion actuation sleeve assembly 644. Each arm 642 comprises an arcuate elongated member which is located in a window 720. Each arm 642 includes a spherically shaped radially inwardly extending lug 738 which mates in a cylindrical recess 732 of the ball valve 640, a radially inwardly extending lug 740, and a radially inwardly extending lug 742, located at the lower end of the arm 642, which mates actuator sleeve assembly 644.

Lost-motion actuator sleeve assembly 644 includes a first elongated annular operating connector 744 secured to a second elongated connector insert 746. Operating connector 744 is formed having first annular chamfered surface 748, first bore 750, second annular chamfered surface 752, second bore 754, annular radial wall 756, third bore 758, and threaded bore 760. The exterior of operating connector 744 includes first annular surface 762, annular recess 764, and cylindrical exterior surface 766. Connector insert 746 includes a first cylindrical bore 768 and a second, larger bore 770. The leading edge of insert 746 is radially flat annular wall 772. The trailing edge of insert 746 comprises radially flat annular wall 774. The exterior of insert 746 comprises threaded exterior surface 776, radially flat annular wall 778, and smooth cylindrical exterior surface 780.

Lost-motion actuator sleeve assembly 644 further includes a plurality of arcuate locking dogs 782 of rectangular cross-section and having annular recesses 784 and 786 in the exterior thereof. Locking dogs 782 are disposed in annular recess 788 formed between operating connector 744 and differential piston 746. Garter springs 790 are disposed in the recesses 784 and 786 of locking dogs 782. Garter springs 790 radially inwardly bias dogs 782 against the exterior of shear mandrel 792, shear mandrel 792 being part of the lost-motion valve actuator means.

Operating connector 744 engages arms 642 via the interaction of lugs 740 and 742 with shoulder 762 and recess 764. First bore 750 of operating connector 744 sealingly engages exterior surface 715 of ball valve cage 638.

The power section 800 of formation tester tool 29 comprises shear nipple 802, shear mandrel 792, power cylinder 804, compression mandrel 806, filler valve body 808, nitrogen chamber case 810, nitrogen chamber mandrel 812, and floating balancing piston 814.

Shear nipple 802 comprises an elongated tubular body including a first bore 816, a radial wall 817, a second bore 818, and a third bore 820 having inwardly radially extending splines 822 thereon. The leading edge of nipple 802 is an annular, radially flat wall 824, while the trailing edge is an annular, radially flat wall 825 having slots 826 therein. The exterior of shear nipple 802 includes a leading threaded surface 828, a cylindrical surface 830, and a trailing threaded surface 832. A shear pin retainer 834 is threaded into aperture 836 to maintain shear pin 838 in place. Shear pin 838 extends into annular groove 840 in shear mandrel 792.

Shear mandrel 792 comprises an elongated tubular member having a cylindrical exterior surface 842 in which annular dog slot 844 and shear pin groove 840 are cut. Below surface 842, splines 846 extend radially outwardly to mesh with splines 822 of shear nipple 802. Below splines 846 are disposed cylindrical seal surface 848 and threaded surface 850. The interior of shear mandrel 792 comprises smooth bore 852. Vent passages 854 extend through the wall of mandrel 792 between the interior and exterior thereof. Seal means 856, carried in recess 858 on the interior of shear nipple 802, slidingly seal against shear mandrel 792.

Below shear nipple 802, the outer annular surface 860 of compression mandrel 806 rides against inner wall 862 of power cylinder 804, seal means 864 in recess 826 slidingly sealing between surface 860 and wall 862. Above compression mandrel 806, O-ring 868 seals between shear nipple 802 and power cylinder 804. O-ring 870 seals between compression mandrel 806 and seal surface 848 of shear mandrel 792.

Well fluid power chamber 872, fed by power ports 874 through the wall of power cylinder 804, is defined between shear nipple 802, power cylinder 804, compression mandrel 806 and shear mandrel 792. Power chamber 872 varies in length and volume during the stroke of shear mandrel 792 and compression mandrel 806.

The lower portion of compression mandrel 806 comprises tubular segment 876 below radial face 878. The tubular segment 876 has a cylindrical exterior surface 880.

Filler valve body 808 includes a cylindrical medial portion, above and below which are extensions of lesser diameter by which filler valve body 808 is threaded at 882 to power mandrel 804 and at 884 to nitrogen chamber 810. The upper interior of filler valve body 808 includes bore wall 886, in which tubular segment 876 of compression mandrel 806 is received. Seal means 888 and 890 are carried by filler valve body 808 and provide a sliding seal between filler valve body 808 and tubular segment 876. Annular relief chamber 892, between seal means 888 and 890, communicates with the exterior of the tool via oblique relief passage 894 to prevent the occurrence of pressure locking during the stroke of mandrel 806. Below bore wall 886, radial shoulder 896 necks inwardly to constricted bore wall 898. Below bore wall 898, beveled surface 900 extends outwardly to threaded junction 902. Threaded junction 902 connects filler valve body 808 and nitrogen chamber mandrel 812. Seal means 904 carried on mandrel 812 seals body 808 and mandrel 812.

A plurality of longitudinally extending passages 906 in filler valve body 808 communicate between upper nitrogen chamber 908 and lower nitrogen chamber 910. Filler valve body 808 contains a nitrogen filler valve, such as is known in the art, whereby chambers 908 and 910 of the tool are charged with nitrogen from a pressurized cylinder.

Nitrogen chamber case 810 comprises a substantially tubular body having a cylindrical inner wall 912. Nitrogen chamber mandrel 812 is also substantially tubular and possesses an annular shoulder 914 at the upper end thereof which carries seal means 904, seal means 904 being contained between flange 916 and filler valve body 808. Annular floating balancing piston 814 rides on exterior surface 918 of mandrel 812. Seal means 920 and 922 carried on piston 814 provide sliding seals between piston 814 and inner wall 912 and between piston 814 and exterior surface 918.

The lower end of nitrogen chamber case 810 is threaded at 924 to metering cartridge housing 930 of metering section 1100. Metering section 1100 further comprises extension mandrel 932, metering mandrel 934, metering cartridge body 936, metering nipple 938, metering case 940, floating oil piston 942, and lower adapter 944.

Metering cartridge housing 930 carries O-ring 931 thereon which seals against inner seal surface 946 of nitrogen chamber case 810. Nitrogen chamber mandrel 812 is joined to extension mandrel 932 at threaded junction 948, seal means 949 carried in mandrel 932 sealing against seal surface 950 on mandrel 812. The upper end 956 of metering mandrel 934 extends over lower cylindrical surface 952 on extension mandrel 932, seal means 954 effecting a seal therebetween. Metering mandrel 934 necks down below upper end 956 to a smaller exterior diameter portion comprising metering cartridge body saddle 958.

Metering cartridge body 936 carries a plurality of O-rings 960 which seal against the interior of metering cartridge housing 930 and against saddle 958. Body 936 is maintained in place on saddle 958 by the upper end 956 of metering mandrel 934 and by the upper face 962 of metering nipple 938.

Metering nipple 938 is secured at 966 to housing 930, O-ring 968 effecting a seal therebetween, and at 970 to metering case 940, O-ring 972 effecting a seal therebetween. Oil filler port 974 extends from the exterior of formation tester tool 29 to annular passage 976 defined between nipple 938 and metering mandrel 934, plug 978 closing port 974. Passage 976 communicates with upper oil chamber 980 through metering cartridge body 936. Passage 976 also communicates with lower oil chamber 982, the lower end of chamber 982 being closed by annular floating oil piston 942. Piston 942 carries O-rings 984 thereon which maintain a sliding seal between floating piston 942 and cylindrical inner surface 986 of metering case 940 and between piston 942 and cylindrical exterior surface 988 of metering mandrel 934. Pressure compensation ports 988 extend through the wall of case 940 to a pressure compensation chamber 990 located below piston 942. Lower adapter 944 is threaded to metering case 940 at 992, O-ring 994 maintaining a seal therebetween. Bore 996 of metering case 940 receives the lower end of metering mandrel 934 therein, seal means 998 effecting a seal therebetween. The exit bore 1000 of lower adapter 944, as well as the bores 1002 of metering mandrel 934, 1004 of extension mandrel 934, and 1006 of nitrogen chamber mandrel 812, are of substantially the same diameter. Threads 1008 on the exterior of lower adapter 944 connect tester tool 29 to the portion of the testing string extending below tester tool 29.

Metering cartridge body 936 has a plurality of longitudinally extending passages 1020 therethrough, each passage having a fluid resistor 1022 disposed therein. Suitable fluid resistors are described, for example, in U.S. Pat. No. 3,323,550, the entire disclosure of which is incorporated herein by reference. Alternatively, conventional relief valves may be substituted for, or used in combination with, fluid resistors 1022.

In accordance with the present invention and as explained hereinbelow, formation tester tool 29 is preferably run into well bore 3 with ball 640 in its open position as depicted in FIGS. 8A–8E. At some point during the lowering process, the hydrostatic pressure in annulus 16 will exceed the pressure of the inert gas in chambers 908 and 910 so that oil piston 942 is forced upward. When oil piston 942 moves upward, a portion of the oil in chamber 982 and in passage 976 is caused to flow through metering cartridge body 936 and into chamber 980. The fluid flowing into chamber 980 acts to force floating balancing piston 814 upward, thus compressing the inert gas in chambers 910 and 908. Fluid will continue to flow into chamber 980 from passage 976 until the pressure of the inert gas in chambers 908 and 910 is equivalent to the fluid pressure existing in annulus 16 immediately outside of formation tester tool 29. As a result of this process, the pressure of the inert gas in chambers 908 and 910 is automatically supplemented to compensate for the increasing hydrostatic fluid pressure in the annulus.

When testing string 10 is in place in well bore 3 with packer 27 set to prevent fluid communication between formation 5 and annulus 16, the fluid pressure in annulus 16 must be increased substantially in order to place formation tester tool 29 in its operational mode. This annulus pressure increase is communicated directly to the top of compression mandrel 806 via port 874. The annulus pressure increase is also communicated directly to floating oil piston 942, thus pushing oil piston 942 upward and thereby compressing the fluids contained in oil chambers 982 and 980, passage 974, and nitrogen chambers 908 and 910. However, due to the flow restricting action of metering cartridge 936, the transmission of the annulus pressure increase to chambers 980, 910, and 908 via piston 942 is delayed. Consequently, for a brief period following the annulus pressure increase, the pressure above compression mandrel 806 is significantly greater than the pressure below mandrel 806. This pressure differential operates to push compression mandrel 806 and shear mandrel 792, which is connected to mandrel 806, downward such that pins 838 are sheared. After mandrel 806 moves downward, a sufficient amount of oil eventually flows through metering cartridge 936 so that the gas pressure in chamber 910 is again equalized with the fluid pressure existing in annulus 16 immediately outside of formation tester valve 29.

As shear mandrel 792 moves downward in response to the annulus pressure increase, locking dogs 782 become aligned with, and thus collapse into, dog slot 844 in mandrel 792. When dogs 782 collapse into dog slot 844, valve operating connector 744 is thereby locked onto mandrel 792 so that valve operating arms 642 and valve operating connector 744 are thereafter operated by the longitudinal movement of compression mandrel 806 and shear mandrel 792.

After formation tester tool 29 has been placed in its operational mode, ball valve 640 can be rotated to its closed position by releasing the pressure being applied to the well bore annulus. The resulting decrease in annulus pressure is immediately communicated to the top of compression mandrel 806 via port 874. However, due once again to the flow restricting action of metering cartridge 936, the gas pressure beneath compression mandrel 806 remains very high for a brief period of time following the annulus pressure decrease. The resulting pressure differential created across compression mandrel 806 forces mandrel 806 upward. As shear mandrel 806 moves upward, mandrel 806 also pushes shear mandrel 792, valve operating connector 744, valve operating arms 642, and lugs 738 upward. The upward movement of arms 642 and lugs 738 operates to rotate ball valve 650 to its closed position.

As is apparent, subsequent alternating annulus pressure increases and decreases can be used to open and close formation tester tool 29.

A more detailed description of the structure and operation of the annulus pressure operated formation testing tool 29 depicted in FIGS. 8A–8E is provided in U.S. Pat. No. 4,655,288, the entire disclosure of which is incorporated herein by reference.

The Inventive Method

In the inventive method, the apparatus of the present invention is inserted into a well bore. The inventive apparatus is preferably inserted into the well bore with (a) the bore closure valve of formation tester tool 29 open, (b) the bore closure valve of drill stem tester tool 25 closed, and (c) the reverse circulation valve of circulation tool 22 open whereby fluid is allowed to flow from the exterior of tool 22 to the fluid flow passageway extending longitudinally through tool 22. When the testing string is inserted into the well bore in this manner, fluid from well bore annulus 16 flows into the testing string via circulation tool 22 as the string is lowered into the well and thereby fills the portion of the testing string extending above the bore closure valve of the drill stem tester tool.

During the testing string lowering process, drill stem pressure tests are periodically conducted in order to determine if the testing string contains any leaks. Each drill stem pressure test is preferably conducted by (a) momentarily stopping the insertion of the testing string, (b) closing the reverse circulation valve of circulation tool 22 so that the interior of tool 22 is no longer in fluid communication with the exterior of tool 22, (c) maintaining the drill stem tester tool 25 in its drill pipe tester mode whereby the bore closure valve of tool 25 remains closed, (d) pumping into the testing string in order to increase the fluid pressure therein at all points above the bore closure valve of drill stem tester tool 25, (e) holding the testing string at an increased pressure in order to determine if the string contains any leaks, (f) releasing the pressure applied to the testing string, (g) opening the reverse circulation valve of circulation tool 22 so that fluid is once again allowed to flow from the exterior of tool 22 to the interior of tool 22, (h) maintaining the bore closure valve of drill stem tester tool 25 in its closed position, and (i) resuming the process of lowering the testing string into the well bore. By using the preferred circulation tool 22 described hereinabove, the preferred drill stem tester tool 25 described hereinabove, and formation tester tool 29 described hereinabove, the reverse circulation valve of circulation tool 22 can be closed and open, as required for conducting each drill stem pressure test, using internal-external pressure differential changes which do not operate to change either the operating mode of drill stem tester tool 25 or the operating mode of the formation tester valve 29.

In conducting the inventive method, internal-external differential pressure operated circulation tool 22 is preferably placed in its reverse circulation mode prior to being inserted into the well bore. To place tool 22 in its reverse circulation mode, ball 220 is positioned in a leg 207 adjacent a slot surface 218. With ball 220 positioned adjacent a surface 218, valve mandrel 118 is positioned in tool 22 such that bores 150 are in fluid communication with port 152. As tool 22 is lowered into the well bore, the hydrostatic head generated by the fluid in well bore annulus 16 creates a pressure differential across valve 142 and thus causes fluid from annulus 16 to flow through port 152, through bore 150, through valve 142, and into the testing string.

When tool 22 is placed in its reverse circulation mode, the upper surface 250 of lower piston mandrel 186 is abutted against lower abutment surface 248 of shoulder 224. The abutment of surface 250 with surface 248 limits the upward movement of valve mandrel 118 in tool 22. Thus, tool 22 remains in its reverse circulation mode in spite of the increasing annulus pressure encountered by the tool as the tool travels down the well bore.

As indicated hereinabove, annulus pressure operated drill stem tester tool 25 is preferably placed in its drill stem tester mode prior to being inserted into the well bore. In order to place tool 25 in its drill stem tester mode, ball 386 is placed in position "a" in slot 384. With ball 386 in position "a", ball valve 530 is closed, circulation apertures 432 are positioned above and isolated from circulation ports 424, and nitrogen displacement apertures 456 are positioned above and isolated from nitrogen displacement ports 426.

As annulus operated drill stem testing tool 25 is lowered into the well bore, the increasing annulus hydrostatic pressure encountered by tool 25 operates through port 354 to push floating piston 412 upward. The upward movement of piston 412, in turn, operates to force ball sleeve assembly 366 upward. As ball sleeve assembly 366 moves upward, ball 386 moves to position "b" in slot 364. However, ball sleeve assembly 366 and ball 386 cannot move a sufficient distance upward from position "a" to cause ball 386 to shoulder in slot 364 and thereby effect a change in the operating mode of tool 25. As ball sleeve assembly 366 and ball 386 move upwardly from position "b" to position "c", piston 390 abuts against overshot 327. When piston 390 abuts overshot 327, the upward movement of piston 390 stops and shoulder 370 separates slightly from piston 390. When shoulder 370 separates from piston 390, a sufficient amount of ratchet chamber fluid flows between shoulder 370 and piston 390 to equalize the fluid pressure existing above and below ball sleeve assembly 366. As a result, the upward movement of ball sleeve assembly 366 ceases before ball 386 reaches an end surface of slot 364. Consequently, the increasing annulus hydrostatic pressure encountered by tool 25 as tool 25 is lowered into the well bore cannot operate to change the operating mode of tool 25.

As also indicated hereinabove, annulus pressure operated formation testing tool 29 is preferably inserted into the formation with ball valve 630 open and with shear pin 838 in place such that shear mandrel 792 is prevented from moving longitudinally inside tool 29. As tool 29 moves downward in well bore 3, the hydrostatic annulus pressure encountered by tool 29 may at some point exceed the pressure of the inert gas in chambers 908 and 910. If this occurs, the hydrostatic annulus pressure acts through port 988 to push piston 942 upward. The upward movement of piston 942, in turn, pushes oil through metering cartridge 936 and into chamber 980. The oil entering chamber 980 pushes floating balancing piston 814 upward and thus operates to compress the inert gas in chambers 910 and 908. This compression action ceases when the pressure in chambers 910 and 908 is equivalent to the pressure existing in the annulus 16 immediately outside of tool 29.

The increasing hydrostatic annulus pressure encountered by formation testing tool 29 as tool 29 travels down well bore 3 also operates through port 874 to exert an increasing downward force against compression mandrel 806. However, the hydrostatic annulus pressure encountered by tool 29 as tool 29 travels down the well bore is always well below the annulus pressure necessary to cause the shearing of pin 838. Thus, the increasing hydrostatic annulus pressure encountered by tool 29 as tool 29 travels down the well bore does not operate to change the operating mode of formation tester tool 29.

In the inventive method, as discussed above, drill stem pressure tests are preferably conducted periodically as testing string 10 is lowered into well bore 3. Each drill stem pressure test is preferably conducted in the manner described hereinbelow.

First, the reverse circulation valve of circulation tool 22 is closed by increasing the internal pressure of the testing string sufficiently to drive piston mandrel 170 of tool 22 downward and thus move ball 220 upward in leg 205(*a*) until ball 220 is adjacent surface 216(*a*). Before ball 220 abuts surface 216(*a*), surface 252 on the lower end of lower valve sleeve 224 abuts against surface 254 on the upper end of intermediate housing section 112. The abutment of surface 252 with surface 254 stops the downward movement of piston mandrel 170 and thus prevents ball 220 from abutting surface 216(*a*).

With ball 220 adjacent to surface 216(*a*), O-ring 120 on valve mandrel 118 is positioned beneath port 150 of circulation valve 22 so that bores 150 are no longer in fluid communication with port 152 (i.e., the reverse circulating valve of tool 22 is closed). However, with valve mandrel 118 in this position, circulation bores 166 are in fluid communication with port 152 such that fluid can be circulated from the interior of the testing string to well bore annulus 16 (i.e., the circulation valve of tool 22 is open). Once ball 220 is positioned adjacent surface 216, the internal string pressure is released so that fluid does not flow from the string into annulus 16.

Since drill stem tester tool 25 and formation tester tool 29 are strictly annulus pressure operated, increasing the testing string interior pressure does not affect the operating mode of either tool 25 or tool 29.

Next, the pressure in annulus 16 is increased sufficiently to close both the circulation valve and the reverse circulation valve of circulation tool 22 without changing the operating mode of either the drill stem tester tool 25 or the formation tester tool 29. Given a final tool depth of 12,000 feet, tool 25 and tool 29, when fully lowered in well bore 3, will be subjected to a maximum annulus hydrostatic pressure of about 8,000 psia. However, even under these conditions, the pressure in annulus 16 must be increased by well over 500 psi in order to change the operating modes of drill stem tester tool 25 and formation tester tool 29. The operating mode of circulation tool 22, on the other hand, can be changed at any depth in the well bore by creating a pressure differential of only about 400 psi between the interior of tool 22 and the exterior of tool 22. Thus, the circulation valve of circulation tool 22 is preferably closed in this second step of the drill stem testing procedure by increasing the pressure in annulus 16, using pump 15, by an amount in the range of from about 400 psi to about 500 psi.

When the annulus pressure is increased in the manner just described, a pressure differential is created between the exterior and the interior of circulation tool 22 such that piston mandrel 170 is driven upward. As piston mandrel 170 moves upward, ball 220 travels down leg 205(*a*) and through transition slot 208 until it is positioned adjacent surface 214. Ball 220 is prevented from contacting surface 214 by the abutment of upper abutment surface 238 of lug 236 with lower abutment surface 244 of shoulder 222.

When ball 220 of tool 22 is positioned adjacent surface 214, valve mandrel 118 of tool 22 is positioned over port 152 such that port 152 is located between O-rings 122 and 124. With valve mandrel 118 thus positioned in tool 22, both the circulation valve and the reverse circulation valve of tool 22 are closed and string 10 is ready for a drill stem pressure test.

In conducting the drill stem pressure test, the annulus pressure generated to close the tool 22 valves is released and the internal pressure of the testing string is increased by an amount of up to about 15,000 psi. Due to its desirable valve ball section design, the preferred drill stem tester tool 25 used in the inventive apparatus allows the use of drill stem test pressures which are up to 5,000 psi higher than the test pressures allowed by other drill stem testing tools commonly used in the art.

When the interior pressure of testing string 10 is increased in order to conduct the drill stem pressure test, a pressure differential is created between the interior and the exterior of circulation tool 22 such that piston mandrel 170 is forced downward. As piston mandrel 170 moves downward, ball 220 travels up leg 210 until it is positioned adjacent surface 212. Ball 220 is prevented from contacting surface 212 by the abutment of lower surface 240 of lug 236 with upper surface 246 of shoulder 224. Since the drill stem pressure test itself involves only an interior string pressure change, the operating modes of drill stem tester tool 25 and formation tester tool 29 are not affected by the drill stem pressure test.

After the drill stem pressure test is completed, the internal string pressure is released and the testing string is lowered further into well bore 3. However, prior to resuming the lowering of testing string 10, circulation tool 22 is preferably again placed in its reverse circulation mode so that fluid will flow from annulus 16 into testing string 10 as testing string 10 is lowered into well bore 3. As is fully explained in U.S. Pat. No. 4,657,082, circulation tool 22 is returned to its reverse circulation mode by sequentially and repeatedly (1) increasing the pressure in annulus 16 by an amount in the range of from about 400 to about 500 psi so that piston mandrel 170 is driven upward, (2) releasing the pressure applied to annulus 16, (3) increasing the internal pressure of testing string 10 by an amount sufficient to drive piston mandrel 170 downward, and (4) releasing the pressure applied to the interior of testing string 10. These steps are repeated until ball 220 travels from its position adjacent surface 212 to a position adjacent surface 218(*b*) in leg 207(*b*). As is apparent, the operating modes of drill stem testing tool 25 and formation testing tool 29 are not changed as circulation tool 22 is returned to its reverse circulation mode since the pressure in annulus 16 is never increased by an amount significantly exceeding 500 psi.

As indicated above, numerous drill stem pressure tests are preferably conducted as testing string 10 is lowered toward its final position in well bore 3. By using the apparatus of the present invention, these drill string pressure tests can be conducted easily and quickly. By conducting numerous drill string pressure tests, testing string leaks can be detected quickly so that testing string 10 can be repaired without having to withdraw a substantial portion of the testing string from the well.

When packer 27 is set in well bore 3 and testing string 10 is in its final position in well bore 3, as depicted in FIG. 1, the bore closure valve of drill stem tester tool 25 can be used as a backup for formation tester tool 29. Additionally, when the preferred circulation tool 22 and the preferred drill stem testing tool 25 are used in the testing string, the testing string 10 contains two independently operated circulation valves and two independently operated reverse circulation valves. Thus, if one of tools 22 and 25 is somehow rendered inoperable, the other tool can be used for conducting later circulation operations (e.g., for spotting a cushion of diesel downhole) and reverse circulation operations.

Thus, the present invention is well adapted to carry out the objects and obtain the ends and advantages mentioned above as well as those inherent therein. While numerous changes will be apparent to those skilled in the art, such changes are encompassed within the scope of the invention as defined by the appended claims.

What is claimed is:

1. An apparatus for testing a subterranean formation comprising:

internal-external differential pressure operated circulation tool comprising an elongate tubular housing having a passageway extending longitudinally therethrough, said circulation tool further comprising a reverse circulation valve means for allowing fluid flow from the exterior of said circulation tool to said passageway of said circulation tool and said circulation tool also comprising a first operating means, responsive to changes in fluid pressure differential between said passageway of said circulation tool and the exterior of said circulation tool, for selectively opening said reverse circulation valve means to allow fluid flow from the exterior of said circulation tool to said passageway of said circulation tool and for closing said reverse circulation valve means;

an external pressure operated drill stem testing tool comprising an elongate tubular housing having a passageway extending longitudinally therethrough, said drill stem testing tool further comprising a passageway closure valve means for selectively blocking said passageway of said drill stem testing tool and said drill stem testing tool also comprising a second operating means, responsive to pressure changes exterior to said drill stem testing tool, for selectively closing said passageway closure valve means of said drill stem testing tool in order to block said passageway of said drill stem testing tool and opening said passageway closure valve means of said drill stem testing tool; and an external pressure operated formation tester tool comprising an elongate tubular housing having a passageway extending longitudinally therethrough, said formation tester tool further comprising a passageway closure valve means for selectively blocking said passageway of said formation tester tool and said formation tester tool also comprising a third operating means, responsive to pressure changes exterior to said formation tester tool, for selectively opening and closing said passageway closure valve means of said formation tester tool to block said passageway of said formation tester tool and to open said passageway of said formation tester tool, said drill stem testing tool being positioned in a testing string beneath said circulation tool and said formation tester tool being positioned in said testing string beneath said drill stem testing tool, and said first operating means being responsive to fluid pressure differential changes between the exterior and the interior of said testing string which will not operate to change the position of said passageway closure valve means of said drill stem testing tool and will not operate to change the position of said passageway closure valve means of said formation tester tool.

2. The apparatus of claim 1 wherein:

said housing of said circulation tool has a circulation port extending through the wall thereof;

said reverse circulation valve means comprises a valve mandrel slideably received in said housing of said circulation tool and having a first aperture therethrough; and said valve mandrel is longitudinally moveable in said housing of said circulation tool between a first position wherein said first aperture of said circulation tool is placed in fluid communication with said circulation port whereby fluid is allowed to flow from the exterior of said circulation tool to said passageway of said circulation tool and a second position wherein said first aperture is placed out of fluid communication with said circulation port.

3. The apparatus of claim 2 wherein said first operating means comprises an annular piston means slideably received in said housing of said circulation tool, said piston means having a first portion subject to the fluid pressure in said passageway of said circulation tool and a second portion subject to the fluid pressure exterior to said circulation tool, said annular piston means being operable for moving said valve mandrel toward one of said positions when the fluid pressure in said passageway of said circulation tool exceeds the fluid pressure exterior to said circulation tool and said annular piston means being operable for moving said valve mandrel toward the other of said positions when the fluid pressure exterior to said circulation tool exceeds the fluid pressure in said passageway of said circulation tool.

4. The apparatus of claim 3 wherein said circulation tool further comprises a ball, groove, and lug means, associated with said housing of said circulation tool and with said first operating means, for regulating the longitudinal movement of said valve mandrel in said housing of said circulation tool.

5. The apparatus of claim 4 wherein said circulation tool further comprises a first check valve means, connected to said valve mandrel and associated with said first aperture, for preventing fluid flow from said passageway of said circulation tool to the exterior of said circulation tool.

6. The apparatus of claim 5 wherein said valve mandrel has a second aperture therethrough and wherein said valve mandrel is longitudinally moveable in said housing of said circulation tool to a third position wherein said second aperture is placed in fluid communication with said circulation port whereby fluid is allowed to flow from said passageway of said circulation tool to the exterior of said circulation tool.

7. The apparatus of claim 6 further comprising a second check valve means, connected to said valve mandrel and associated with said second aperture, for preventing fluid flow from the exterior of said circulation tool to said passageway of said circulation tool.

8. The apparatus of claim 1 wherein said second operating means comprises a mandrel means which is slideably received in said housing of said drill stem testing tool and is operatively associatable with said passageway closure valve of said drill stem testing tool.

9. The apparatus of claim 8 wherein said second operating means further comprises a double acting piston means, slideably received in said housing and operatively associatable with said mandrel means, for moving said mandrel means longitudinally in said housing of said drill stem tester tool in response to said pressure changes exterior to said drill stem testing tool.

10. The apparatus of claim 9 wherein said double acting piston means includes a fluid bypass means for limiting the longitudinal travel of said double acting piston means.

11. The apparatus of claim 9 wherein said second operating means further comprises a ball and slot means for operably associating said double acting piston means with said mandrel means.

12. The apparatus of claim 11 wherein:

said housing of said drill stem testing tool has a first port extending through the wall thereof; and said drill stem testing tool further comprises a valve sleeve means slideably received in said housing and having a first aperture therethrough, said mandrel means being operatively associated with said valve sleeve means and said valve sleeve means being longitudinally positionable in said housing of said drill stem testing tool such that said first aperture is placeable in fluid communication with said port whereby said passageway of said drill stem testing tool can be placed in fluid communication with the exterior of said drill stem testing tool.

13. The apparatus of claim 12 wherein said aperture cannot be placed in fluid communication with said port when said passageway closure valve means of said drill stem testing tool is open.

14. The apparatus of claim 13 wherein said aperture can be selectively placed into and taken out of fluid communication with said port when said passageway closure valve means of said drill stem testing tool is closed.

15. The apparatus of claim 14 wherein:

said housing of said drill stem testing tool has a second port extending through the wall thereof;

said valve sleeve means has a second aperture extending therethrough; and said valve sleeve means is longitudinally positionable in said housing of said drill stem testing tool such that said second aperture is placeable in fluid communication with said second port whereby said passageway of said drill stem testing tool can be placed in fluid communication with the exterior of said drill stem testing tool.

16. The apparatus of claim 15 wherein said second aperture cannot be placed in fluid communication with said second port when said passageway closure valve means of said drill stem testing tool is open or when said first aperture is in fluid communication with said first port.

17. The apparatus of claim 16 wherein said drill stem testing tool further comprises means for preventing fluid flow from the exterior of said drill stem testing tool to said passageway of said drill stem testing tool when said second aperture is in fluid communication with said second port.

18. The apparatus of claim 1 wherein said third operating means comprises a mandrel means which is slideably received in said housing of said formation tester tool and operatively associatable with said passageway closure valve means of said formation tester tool.

19. The apparatus of claim 18 wherein said passageway closure valve means of said formation tester tool comprises a valve ball rotatably positioned in said housing of said formation tester tool.

20. A method of positioning a formation tester valve in a well bore comprising the steps of:

(a) running a testing string into a well bore, said testing string comprising:

an internal-external differential pressure operated circulation tool comprising an elongate tubular housing having a passageway extending longitudinally therethrough, said circulation tool further comprising a reverse circulation valve means for allowing fluid flow from the exterior of said circulation tool to said passageway of said circulation tool and said circulation tool also comprising a first operating means, responsive to changes in fluid pressure differential between said passageway of said circulation tool and the exterior of said circulation tool, for selectively opening said reverse circulation valve means to allow fluid flow from the exterior of said circulation tool to said passageway of said circulation tool and closing said reverse circulation valve means;

an external pressure operated drill stem testing tool comprising an elongate tubular housing having a passageway extending longitudinally therethrough, said drill stem testing tool further comprising a passageway closure valve means for selectively blocking said passageway of said drill stem testing tool and said drill stem testing tool also comprising a second operating means, responsive to pressure changes exterior to said drill stem testing tool, for selectively closing said passageway closure valve means of said drill stem testing tool in order to block said passageway of said drill stem testing tool and opening said passageway closure valve means of said drill stem testing tool; and an external pressure operated formation tester tool comprising an elongate tubular housing having a passageway extending longitudinally therethrough, said formation tester tool further comprising a passageway closure valve means for selectively blocking said passageway of said formation tester tool and said formation tester tool also comprising a third operating means, responsive to pressure changes exterior to said formation testing tool, for selectively opening and closing said passageway closure valve means of said formation tester tool to block said passageway of said formation tester tool and to open said passageway of said formation tester tool, said drill stem testing tool being positioned in said testing string beneath said circulation tool and said formation tester tool being positioned in said testing string beneath said drill stem testing tool, said first operating means being responsive to fluid pressure differential changes between the exterior and the interior of said testing string which will not operate to change the position of said passageway closure valve means of said drill stem testing tool and will not operate to change the position of said passageway closure valve means of said formation tester tool, said reverse circulation valve means being in its open position during step (a) such that fluid is allowed to flow from the exterior of said circulation tool to said passageway of said circulation tool, and said passageway closure valve means of said drill stem testing tool being in its closed position during step (a) such that said passageway of said drill stem testing tool is blocked, (b) altering the pressure differential between the interior and the exterior of said testing string such that (i) said reverse circulation valve means is thereby closed but (ii) said passageway closure valve means of said drill stem testing tool remains in its closed position and (iii) the position of said passageway closure valve means of said formation tester tool remains unchanged, (c) increasing the fluid pressure in said testing string above said passageway closure valve means of said drill stem testing tool, and (d) altering the pressure differential between the interior and the exterior of said testing string such that (i) said reverse circulation valve means is thereby opened but (ii) said passageway closure valve means of said drill stem testing tool remains in its closed position and (iii) the position of said passageway closure valve means of said formation tester tool remains unchanged.

21. The method of claim 20 wherein during steps (a), (b), (c), and (d), said passageway closure valve means of said formation tester tool is open.

22. The method of claim 20 further comprising the step, after step (c) and prior to step (d), of determining if said testing string contains leaks.

23. The method of claim 20 wherein the opening and closing of said reverse circulation valve means in steps (b) and (d) is accomplished by creating a predetermined sequence of pressure differentials between said passageway of said circulation tool and the exterior of said circulation tool.

24. The method of claim 23 wherein said well bore has an interior surface, said testing string has an exterior surface, and said interior surface of said well bore and said exterior surface of said testing string define an annulus in said well bore, and wherein said predetermined sequence of pressure differentials is created by alternately increasing the pressure inside one of said testing string or said annulus and then increasing the pressure inside the other of said testing string or said annulus.

25. The method of claim 24 wherein, during steps (a), (b), (c), and (d), the pressure in said annulus is not increased or decreased sufficiently to change the operating mode of said drill stem testing tool.

26. The method of claim 25 wherein, during steps (a), (b), (c), and (d), the pressure in said annulus is not increased or decreased sufficiently to change the operating mode of said formation testing tool.

* * * * *